US009715814B2

(12) United States Patent
Sattari

(10) Patent No.: US 9,715,814 B2
(45) **Date of Patent: *Jul. 25, 2017**

(54) SMART CAREGIVER PLATFORM METHODS, APPARATUSES AND MEDIA

(71) Applicant: Ashkan Sattari, Regina (CA)

(72) Inventor: Ashkan Sattari, Regina (CA)

( * ) Notice: Subject to any disclaimer, the term of this patent is extended or adjusted under 35 U.S.C. 154(b) by 46 days.

This patent is subject to a terminal disclaimer.

(21) Appl. No.: 14/826,039

(22) Filed: Aug. 13, 2015

(65) Prior Publication Data

US 2015/0348396 A1 Dec. 3, 2015

Related U.S. Application Data

(63) Continuation of application No. 14/090,918, filed on Nov. 26, 2013, now Pat. No. 9,142,116.

(60) Provisional application No. 61/730,121, filed on Nov. 27, 2012.

(51) Int. Cl.

| | |
|---|---|
| ***G08B 21/22*** | (2006.01) |
| ***G08B 21/24*** | (2006.01) |
| *G08B 21/04* | (2006.01) |
| *G08B 25/01* | (2006.01) |

(52) U.S. Cl.

CPC ..... *G08B 21/22* (2013.01); *G08B 21/24* (2013.01); *G08B 21/043* (2013.01); *G08B 21/0423* (2013.01); *G08B 21/0446* (2013.01); *G08B 21/0453* (2013.01); *G08B 25/016* (2013.01)

(58) Field of Classification Search

CPC ..... G08B 21/22; G08B 21/24; G08B 21/043; G08B 21/0423; G08B 21/0446; G08B 21/0453; G08B 21/0288; G08B 25/016; G08B 25/01; G08B 25/10

USPC ..... 340/539.11, 539.13, 573.1, 573.4, 995.1, 340/995.19; 455/414.1, 456, 456.1, 457, 455/457.1

See application file for complete search history.

(56) References Cited

U.S. PATENT DOCUMENTS

| | | | | |
|---|---|---|---|---|
| 5,963,130 | A * | 10/1999 | Schlager | G08B 21/0453 340/501 |
| 2003/0151506 | A1 | 8/2003 | Luccketti | |
| 2006/0270421 | A1 | 11/2006 | Phillips et al. | |
| 2008/0062120 | A1* | 3/2008 | Wheeler | G08B 25/016 345/156 |
| 2011/0237226 | A1* | 9/2011 | Dhuna | H04M 1/7253 455/414.1 |
| 2013/0009777 | A1 | 1/2013 | Aarts et al. | |
| 2013/0214925 | A1 | 8/2013 | Weiss | |

OTHER PUBLICATIONS

Notice of Allowance for U.S. Appl. No. 14/090,918, mailed May 14, 2015.

* cited by examiner

*Primary Examiner* — Hung T Nguyen
(74) *Attorney, Agent, or Firm* — Aleksandr Gilshteyn; Lansing Lights LLC

(57) ABSTRACT

It may be determined that analysis of a user's location data indicates that a condition signifying that the user is wandering has been triggered. Directions to an approved location may be generated for the user. It may be concluded that the user did not follow the directions when the user does not reach the approved location within a specified time period, and the user's caregiver may be alerted that the user is wandering.

20 Claims, 10 Drawing Sheets

EXEMPLARY SCGP SWA REQUEST HANDLING (SWARH) COMPONENT

EXEMPLARY SCGP USAGE SCENARIO

EXEMPLARY SCGP SAP REQUEST HANDLING (SAPRH) COMPONENT

EXEMPLARY SCGP SAPRH DATA FLOW

EXEMPLARY SCGP SWA REQUEST HANDLING (SWARH) COMPONENT

EXEMPLARY SCGP SWARH DATA FLOW

EXEMPLARY SCGP USER APP

EXEMPLARY SCGP CAREGIVER APP

EXEMPLARY SCGP CAREGIVER APP

Lost Items Report 810

Range: Last 90 Days 813

| 817 Item | 821 Lost (#) | 825 Lost (%) | 829 Weather | 833 Time |
|---|---|---|---|---|
| Umbrella | 1 | 10% | Rain | Morning |
| Umbrella | 3 | 30% | Rain Likely | Morning |
| Umbrella | 2 | 20% | Rain Likely | Afternoon |
| Wallet | 1 | 10% | Sunny | Morning |
| Wallet | 2 | 20% | Rain | Morning |
| Keys | 1 | 10% | Sunny | Morning |
| Glasses | 0 | 0% | - | - |

User Wandering Report 850

EXEMPLARY SCGP REPORTS

EXEMPLARY SCGP COORDINATOR

SMART CAREGIVER PLATFORM METHODS, APPARATUSES AND MEDIA

This disclosure describes SMART CAREGIVER PLATFORM METHODS, APPARATUSES AND MEDIA (hereinafter "SCGP"). A portion of the disclosure of this patent document contains material which is subject to copyright and/or mask work protection. The copyright and/or mask work owners have no objection to the facsimile reproduction by anyone of the patent document or the patent disclosure, as it appears in the Patent and Trademark Office patent file or records, but otherwise reserve all copyright and mask work rights whatsoever.

CROSS-REFERENCE TO RELATED APPLICATIONS

This is a Continuation of prior U.S. patent application Ser. No. 14/090,918, filed Nov. 26, 2013, now U.S. Pat. No. 9,142,116, entitled "SMART CAREGIVER PLATFORM METHODS, APPARATUSES AND MEDIA," to which priority under 35 U.S.C. §120 is claimed, and which claims priority under 35 U.S.C. §119 to U.S. provisional patent application No. 61/730,121, filed Nov. 27, 2012, entitled "SMART CAREGIVER PLATFORM METHODS, APPARATUSES AND MEDIA".

The entire contents of the aforementioned applications are herein expressly incorporated by reference in their entirety.

FIELD

The present disclosure is directed generally to tracking platforms.

BACKGROUND

People with memory problems may sometimes (e.g., when rushing to leave for work in the morning) have difficulty remembering to take important items (e.g., their medicine) with them and/or may leave behind items they bring with them. Furthermore, people with memory problems may sometimes (e.g., when it is dark and difficult to see) have difficulty remembering how to get to various destinations (e.g., from a grocery store to home) and/or may forget where they are going and may wander aimlessly. While many people with memory problems can live independently these difficulties may make it harder for them to do so and are of concern to their caregivers.

BRIEF DESCRIPTION OF THE FIGURES

The accompanying figures and/or appendices illustrate various exemplary embodiments in accordance with the present disclosure.

DETAILED DESCRIPTION

Introduction

The SCGP helps people with memory problems lead a safe and more independent life while providing peace of mind for their caregivers (e.g., family members, healthcare professionals). The SCGP may accomplish this by creating direct communication between people with disabilities (e.g., Autism, ADHD and vision problem) and their caregivers via an SCGP mobile app. None of the products currently in the market has a solution to directly connect people with memory problem to their caregivers. As a result, the caregivers have to spend too much time taking care and staying informed about their loved one's condition.

The SCGP mobile app may be installed on smart phones of the caregiver and of the user with memory problems. The person with memory problems may also receive a smart bracelet, a smart pillbox, smart tags, and/or the like. For example, the smart bracelet may include a personal help button, a fall detector, and a communication sensor. In one embodiment, the SCGP may remind the user with memory problems to take his personal belongings with him and may give the user a warning if he leaves his smart phone or other items behind. The SCGP may also notify the caregiver if the user loses any of these items and may generate reports (e.g., via text, charts, graphs) showing the caregiver situations in which the user is likely to lose items. In another embodiment, the SCGP may provide a smart location guide (e.g., via GPS) to help keep the user from wandering off and getting lost. The SCGP may help the user travel independently via bus, car, and on foot. The SCGP may also notify the caregiver if the user wanders off or gets lost and may generate reports (e.g., via text, charts, graphs) showing the caregiver situations in which the user is likely to wander off or get lost. In yet another embodiment, the SCGP may facilitate staying in touch with the user by allowing the caregiver to send the user reminders and important information, and to share pictures, videos, text messages, and voice messages with the user.

Detailed Description of the SCGP

Figure 1:
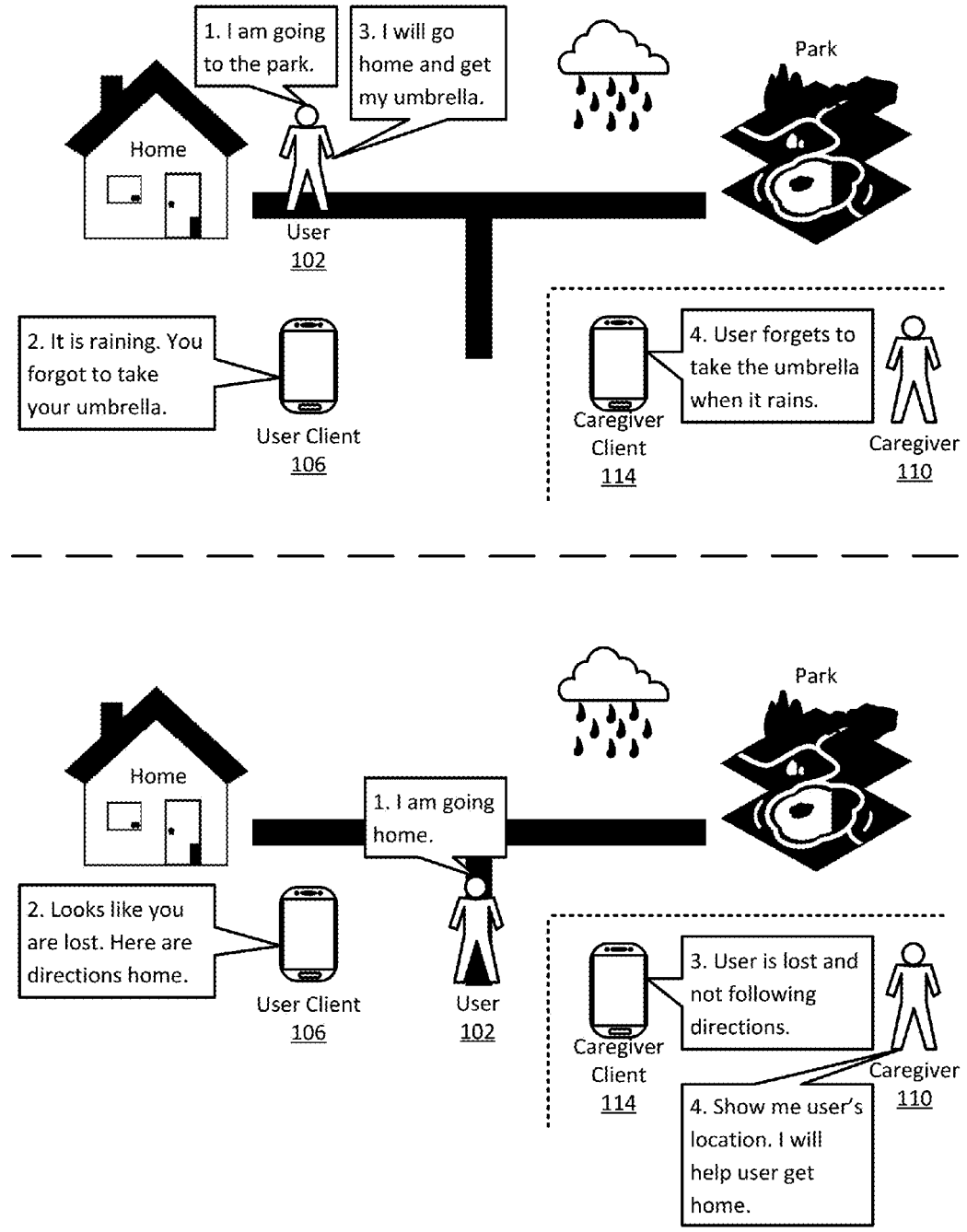
FIG. 1 shows an exemplary usage scenario in one embodiment of the SCGP.

FIG. 1 shows an exemplary usage scenario in one embodiment of the SCGP. In one embodiment, a user with memory problems 102 may wish to go from home to the park. The SCGP may be configured to track that the user takes an umbrella if it is raining outside. Accordingly, if the SCGP detects that it is raining outside and that the user does not have an umbrella, the SCGP may provide a reminder for the user to come back and get the umbrella via the user's client 106. If the user complies, the SCGP may not have to alert the user's caregiver 110 regarding the incident. The caregiver may utilize the SCGP to view reports via the caregiver's client 114 that show the caregiver information such as which items the user is likely to forget and/or lose, under which conditions the user is likely to forget and/or lose items, and/or the like.

In another embodiment, the user may wish to go from the park to home. The SCGP may be configured to help the user navigate if the user is lost and/or wandering. Accordingly, if the SCGP detects that the user is not taking an approved route between approved locations (e.g., the direct route between home and the park), the SCGP may alert the user that the user is lost and/or wondering, and/or may provide the user with turn-by-turn navigation directions to the user's home via the user's client. If the user does not follow the directions, the SCGP may alert the caregivers. The caregiver may utilize the SCGP to track the user's current location via the caregiver's client and/or to help the user get home. For example, the caregiver may call the user and provide the user with directions home while tracking whether the user is following the caregiver's directions.

Figure 2:
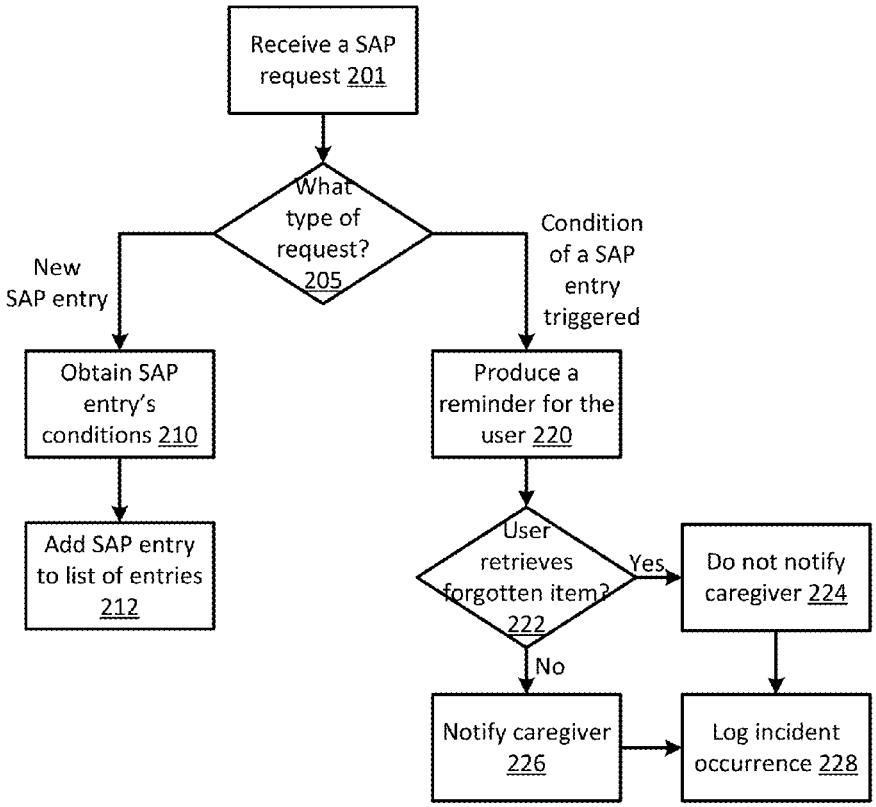
FIG. 2 shows a logic flow diagram illustrating a smart asset protection request handling (SAPRH) component in one embodiment of the SCGP.

FIG. 2 shows a logic flow diagram illustrating a smart asset protection request handling (SAPRH) component in one embodiment of the SCGP. In FIG. 2, a smart asset protection (SAP) request may be received at 201. In one embodiment, the SAP request may be received from a user (e.g., a caregiver) via the user's client (e.g., a smart phone, a laptop). In another embodiment, the SAP request may be generated by the SCGP based on an event (e.g., based on detecting that an item was lost by a user with memory problems). A determination may be made at 205 regarding the type of the SAP request. For example, such a determination may be made based on the contents of the RequestType field of the SAP request via an XML parser.

In one embodiment, the SAP request may be a request to add a new SAP entry. For example, a caregiver and/or a user overseen by the caregiver may wish the caregiver and/or the user to be notified if the user forgets to take an umbrella. The caregiver and/or the user may attach a smart tag (e.g., a smart tag utilizing Bluetooth low energy (BLE) technology) to the umbrella and add a SAP entry that facilitates detecting whether the umbrella was lost and/or forgotten. In various implementations, the smart tag may have a small size, low power consumption, rechargeable battery, and/or the like. The proximity of the umbrella to the user may be tracked by calculating the distance between the smart tag and a tracking device (e.g., a smart bracelet with a BLE communication sensor worn by the user, the user's smart phone with a BLE communication sensor).

Conditions associated with the SAP entry may be obtained at 210. For example, the caregiver may specify that the umbrella should be considered to be forgotten if the user leaves the umbrella at home on a rainy day. In another example, the caregiver may specify that the user's smart phone should be considered to be forgotten if it is not within twenty feet of the user's smart bracelet. In yet another example, the caregiver may specify that the user may be considered to have forgotten to take his medicine if the user does not open his smart pillbox during a specified time (e.g., between 3 pm and 4 pm). In various implementations, conditions may include weather, temperature, geographic location and/or direction of travel, distance from item, time of day, date and/or time, day of the week, month, season, and/or the like. For example, the conditions may be obtained from the Conditions field of the SAP request.

The SAP entry may be added to the list of SAP entries at 212. For example, the name of the item (e.g., umbrella), the identifier of the smart tag associated with the umbrella, conditions associated with detecting that the umbrella was lost and/or forgotten, and/or the like may be added to the SAP Entries data store 930*c* using one or more SQL queries substantially in the following form:

```
INSERT INTO SAPEntries (EntryID, ItemName, SmartTagID,
EntryConditions)
VALUES (ID_Entry1, "Umbrella", ID_SmartTag1, conditions)
```

In another embodiment, the SAP request may be a notification by the SCGP that a condition of a SAP entry has been triggered. In one implementation, this may be detected by periodically checking conditions of entries in the SAP Entries data store 930*c*. For example, the SCGP may detect that the smart tag associated with the umbrella is too far away from the user's smart bracelet and/or smart phone on a rainy day. In another example, the SCGP may detect that the user's smart phone is too far away from the user's smart bracelet. In yet another example, the SCGP may detect that the caregiver set a calendar entry to remind (e.g., via an audio message, a video message, a picture message, a text message) the user to take his medicine at this time. In yet another example, the user may be provided with a smart pillbox, which may automatically detect if the user forgets to take his medicine (e.g., based on whether the smart pillbox was opened during a specified time range).

A reminder for the user may be produced at 220. For example, a reminder (e.g., an audio message such as a beep; a notification on the screen of the user's smart phone via an SCGP app; a notification on the screen of the user's smart bracelet, such as a smart watch, via an SCGP app) may be produced for the user to remind the user to retrieve the forgotten item (e.g., the umbrella, the user's medicine). In another example, the smart pillbox may communicate with the user's smart bracelet and/or smart phone (e.g., via BLE) to instruct the user's smart bracelet and/or smart phone to produce a reminder for the user to take his medicine.

A determination may be made at 222 whether the user retrieves the forgotten item. For example, if the user returns to within a specified distance of the item, and/or opens the smart pillbox to take his medicine, and/or acknowledges the reminder (e.g., by pressing an OK button displayed by the SCGP app) the SCGP may conclude that the user retrieved the item. Otherwise, the SCGP may conclude that the user did not retrieve the item. In some implementations, the user may be given a specified time period (e.g., thirty seconds, five minutes) during which the user may retrieve the item. If the user does not retrieve the item within the specified time period, the SCGP may conclude that the user did not retrieve the item. In some implementations, the SCGP may consider the user's movement during this determination. For example, if the SCGP determines (e.g., using the GPS of the user's smart phone) that the user is moving toward the item, the SCGP may conclude that the user retrieved the item and/or may give the user additional time to retrieve the item. Otherwise, the SCGP may conclude that the user did not retrieve the item.

If the SCGP determines that the user retrieved the item, the SCGP may avoid notifying the caregiver regarding the incident at 224. If the SCGP determines that the user did not retrieve the item, the SCGP may notify the caregiver regarding the incident at 226. For example, the SCGP may send an alert to the caregiver's smart phone. In some implementations, the alert may include the location of the forgotten item and/or the location of the user, and/or the SCGP may facilitate tracking of the forgotten item and/or tracking of the user.

The SCGP may log the occurrence of the incident at 228. For example, the information associated with the incident (e.g., the identifier of the forgotten item, the identifier of the associated smart tag, the identifier of the smart pillbox, conditions associated with the incident, whether the user retrieved the item) may be added to the SAP Logs data store 930*d*. In some implementations, the SCGP may utilize such information to provide the caregiver with useful reports. For example, such reports may facilitate understanding when the user is likely to lose and/or forget items (e.g., during cold/hot/rainy weather, during a particular time of day, when performing certain activities, in particular locations).

Figure 3:
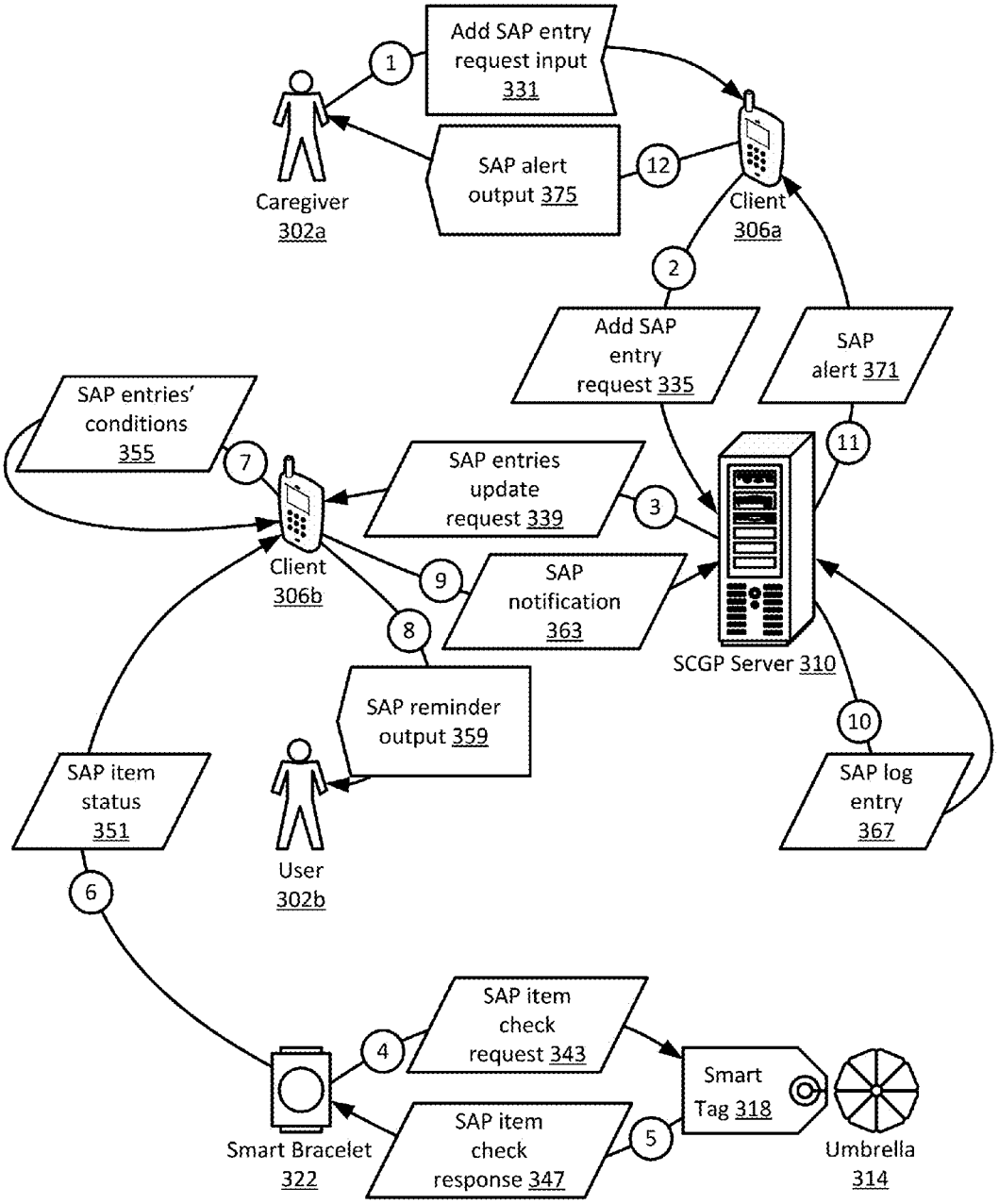
FIG. 3 shows a SAPRH data flow diagram in one embodiment of the SCGP.

FIG. 3 shows a SAPRH data flow diagram in one embodiment of the SCGP. FIG. 3 provides an example of how data may flow to, through, and/or from the SCGP when handling a SAP request. In FIG. 3, a caregiver 302*a* may utilize a client 306*a* (e.g., a smart phone, a laptop) to input a request to add a SAP entry 331. For example, the caregiver may utilize the client's touchscreen to add the SAP entry via a SCGP mobile app. The caregiver may provide details such as the caregiver's username and/or password, the name of an item, an identifier of a smart tag, an identifier of a smart pillbox, conditions associated with the SAP entry, and/or the like.

The client may send a request to add the SAP entry 335 to a SCGP server 310. For example, the add SAP entry request may be in XML format and may include data such as the caregiver's username and/or password, an entry type, information associated with an item, conditions associated with the SAP entry, the date and/or time of the request, and/or the like. In one implementation, the add SAP entry request may be in XML format substantially in the following form:

```
<XML>
<AddSAPEntryRequest>
    <UserName>Caregiver_Username</UserName>
    <EntryType>ForgottenItem</EntryType>
    <Item>
        <ItemName>Umbrella</ItemName>
        <SmartTagID>ID_SmartTag1</SmartTagID>
    </Item>
    <Conditions>
        <Condition>Take when raining</Condition>
        <Condition>Take when chance of rain is >
        50%</Condition>
        <Condition>Not taken if > 20 feet away from
        user</Condition>
    </Conditions>
</AddSAPEntryRequest>
</XML>
```

In one embodiment, the SCGP server may update its list of SAP entries based on the add SAP entry request.

The SCGP server may send a request to update SAP entries 339 to the client 306*b* (e.g., a smart phone, a smart bracelet) of the user with memory problems 302*b*. For example, the SAP entries update request may be in XML format and may include data such as an entry type, information associated with an item, conditions associated with the SAP entry, and/or the like. In one implementation, the SAP entries update request may be in XML format substantially in the following form:

```
<XML>
<SAPEntriesUpdateRequest>
    <AddEntries>
```

-continued

```
        <Entry>
            <EntryID>ID_Entry1</EntryID>
            <EntryType>ForgottenItem</EntryType>
            <Item>
                <ItemName>Umbrella</ItemName>
                <SmartTagID>ID_SmartTag1</
                SmartTagID>
            </Item>
            <Conditions>
                <Condition>Take when raining</Condition>
                <Condition>Take when chance of rain is >
                50%</Condition>
                <Condition>Not taken if > 20 feet away
                from user</Condition>
            </Conditions>
        </Entry>
        <Entry>
            <EntryID>ID_Entry2</EntryID>
            ...
        </Entry>
    </AddEntries>
    <DeleteEntries>
        <Entry>
            <EntryID>ID_Entry3</EntryID>
            ...
        </Entry>
    </DeleteEntries>
</SAPEntriesUpdateRequest>
</XML>
```

In one embodiment, the user's client may keep track of the user's items via a mobile SCGP app that utilizes data regarding SAP entries.

In one embodiment, the user's smart bracelet 322 may communicate with a smart tag 318 associated with the user's item, such as an umbrella 314, to determine the status of the item. In one implementation, the smart bracelet may periodically send a SAP item check request 343 to the smart tag. For example, the SAP item check request may include the identifier of the smart bracelet, the identifier of the smart tag, and/or the like, and may prompt the smart tag to confirm that it is within range via a SAP item check response 347. In one implementation, the SAP item check request may be in XML format substantially in the following form:

```
<XML>
<SAPItemCheckRequest>
    <SmartBraceletID>ID_SmartBracelet1</SmartBraceletID>
    <SmartTagID>ID_SmartTag1</SmartTagID>
    <RequestType>CheckStatus</RequestType>
</SAPItemCheckRequest>
</XML>
```

For example, the SAP item check response may include the identifier of the smart bracelet, may include the identifier of the smart tag, may be analyzed (e.g., based on the strength of the signal) to determine the distance between the smart bracelet and the smart tag, may include data such as the smart tag's battery power indicator (e.g., OK, low, percentage of batter power remaining), and/or the like. In one implementation, the SAP item check response may be in XML format substantially in the following form:

```
<XML>
<SAPItemCheckResponse>
    <SmartBraceletID>ID_SmartBracelet1</SmartBraceletID>
    <SmartTagID>ID_SmartTag1</SmartTagID>
    <ResponseType>Status</ResponseType>
    <Status>
```

-continued

```
                <HardwareStatus>OK</HardwareStatus>
                <BatteryStatus>70% remaining</BatteryStatus>
            </Status>
    </SAPItemCheckResponse>
    </XML>
```

The smart bracelet may provide a SAP item status 351 to the user's client. For example, the SAP item status may include data such as the item's name, the item's smart tag identifier, the smart tag's signal strength, the smart tag's power indicator, and/or the like. In one implementation, the SAP item status may be in XML format substantially in the following form:

```
<XML>
<SAPItemStatus>
    <SmartBraceletID>ID_SmartBracelet1</SmartBraceletID>
    <ClientID>ID_Client1</ClientID>
    <Items>
        <Item>
            <SmartTagID>ID_SmartTag1</SmartTagID>
            <Status>
                <HardwareStatus>OK</HardwareStatus>
                <BatteryStatus>70%
                remaining</BatteryStatus>
                <Distance>15 feet</Distance>
            </Status>
        </Item>
        <Item>
            <SmartTagID>ID_SmartTag2</SmartTagID>
            ...
        </Item>
    </Items>
</SAPItemStatus>
</XML>
```

In another embodiment, communication with the smart tag may be performed by the user's client instead of by the smart bracelet. In this embodiment, the user's client may send SAP item check request, receive SAP item check response, and determine the SAP item's status. For example, the user's client may check the status of the user's smart pillbox. In some implementations, the smart bracelet, such as a smart watch, may be the user's client.

The user's client may periodically analyze SAP entries' conditions 355 based on statuses of items associated with SAP entries to determine whether a condition indicating that an item has been lost and/or forgotten has been triggered. For example, SAP entries' conditions may include weather, temperature, geographic location and/or direction of travel, distance from item, time of day, date and/or time, day of the week, month, season, and/or the like. Data regarding such conditions may be obtained based on statuses of SAP items, based on the client's sensor readings (e.g., current temperature), based on information from third party providers (e.g., predicted weather), and/or the like.

If the SCGP concludes that such a condition has been triggered, a SAP reminder output 359 may be provided to the user. For example, the SAP reminder output may be an audio beep and a textual message informing the user which item (e.g., umbrella) has been lost and/or forgotten. In another example, the SAP reminder output may be a video message from the caregiver (e.g., reminding the user to take his medicine before heading to an adult day care center).

An SAP notification 363 may be sent to the SCGP server to inform the SCGP server regarding the incident. For example, the SAP notification may be in XML format and may include data such as the identifier of the forgotten item, the identifier of the associated smart tag, the identifier of the smart pillbox, conditions associated with the incident, whether the user retrieved the item, and/or the like. In one implementation, the SAP notification may be in XML format substantially in the following form:

```
<XML>
<SAPNotification>
    <NotificationType>ForgottenItem</NotificationType>
    <DateTime>date and time of the incident</DateTime>
    <Item>
        <ItemName>Umbrella</ItemName>
        <SmartTagID>ID_SmartTag1</SmartTagID>
        <Coordinates>geographic coordinates of item's
        location</Coordinates>
    </Item>
    <Conditions>
        <Condition>Raining</Condition>
        <Condition>Item > 20 feet away from user</Condition>
    </Conditions>
    <ReminderProvided>Yes</ReminderProvided>
    <ItemRetrieved>No</ItemRetrieved>
</SAPNotification>
</XML>
```

The SCGP server may generate an SAP log entry 367 recording such data (e.g., in the SAP Logs data store 930*d*). In one implementation, the data may be stored in a log file substantially in the following form:

| EntryType | DateTime | ItemName | Conditions | ReminderProvided | ItemRetrieved |
|---|---|---|---|---|---|
| ForgottenItem | date/time | Umbrella | Raining | Yes | No |

The SCGP server may send a SAP alert 371 to the caregiver's client. The SAP alert may be in XML format and may include data such as the identifier of the forgotten item, the identifier of the associated smart tag, the identifier of the smart pillbox, conditions associated with the incident, whether the user retrieved the item, and/or the like. In one implementation, the SAP alert may be in XML format substantially in the following form:

```
<XML>
<SAPAlert>
    <ClientID>ID_Client2</ClientID>
    <AlertType>ForgottenItem</AlertType>
    <DateTime>date and time of the incident</DateTime>
    <Item>
        <ItemName>Umbrella</ItemName>
        <SmartTagID>ID_SmartTag1</SmartTagID>
        <Coordinates>geographic coordinates of item's
        location</Coordinates>
    </Item>
    <Conditions>
        <Condition>Raining</Condition>
        <Condition>Item > 20 feet away from user</Condition>
    </Conditions>
    <ReminderProvided>Yes</ReminderProvided>
    <ItemRetrieved>No</ItemRetrieved>
    <User>
```

-continued

```
            <Coordinates>geographic coordinates of user's
            location</Coordinates>
        </User>
</SAPAlert>
</XML>
```

The caregiver's client may provide a SAP alert output 375 to the caregiver. For example, the SAP alert output may include information such as a message indicating which item has been lost and/or forgotten, the time and/or date when the incident occurred, the location of the item and/or of the user, whether the user retrieved the item, and/or the like.

Figure 4:
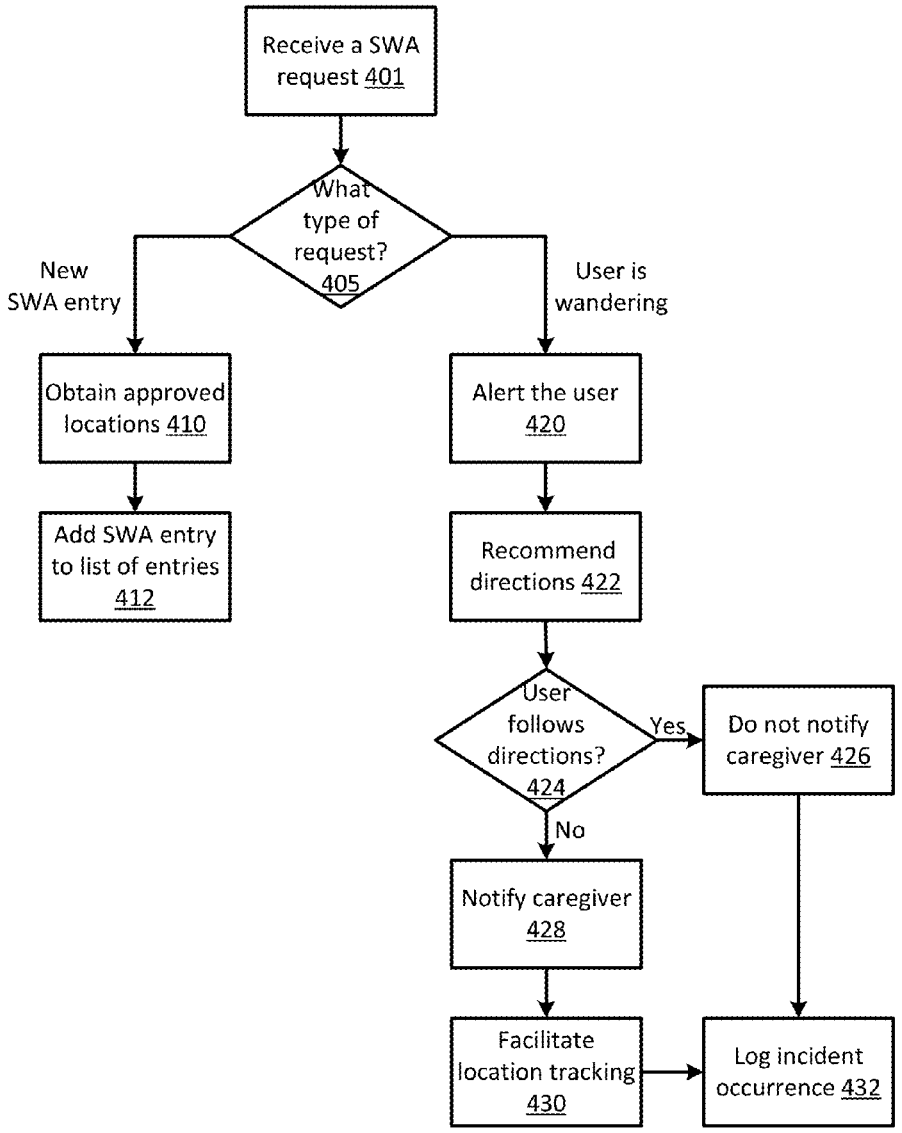
FIG. 4 shows a logic flow diagram illustrating a smart wandering assistant request handling (SWARH) component in one embodiment of the SCGP.

FIG. 4 shows a logic flow diagram illustrating a smart wandering assistant request handling (SWARH) component in one embodiment of the SCGP. In FIG. 4, a smart wandering assistant (SWA) request may be received at 401. In one embodiment, the SWA request may be received from a user (e.g., a caregiver) via the user's client (e.g., a smart phone, a laptop). In another embodiment, the SWA request may be generated by the SCGP based on an event (e.g., based on detecting that a user with memory problems is lost and/or wandering). A determination may be made at 405 regarding the type of the SWA request. For example, such a determination may be made based on the contents of the RequestType field of the SWA request via an XML parser.

In one embodiment, the SWA request may be a request to add a new SWA entry. For example, a caregiver and/or a user overseen by the caregiver may wish the caregiver to be notified if the user is wandering. The caregiver and/or the user may specify approved locations and if the user moves outside the approved locations, the SCGP may consider the user to be wandering.

Approved locations associated with the SWA entry may be obtained at 410. For example, the caregiver may specify that the user should be considered to be wandering if the user is not at one of the approved locations and/or travelling between approved locations (e.g., via an approved route). In another example, the caregiver may specify that the user should be considered to be wandering if the user is outside a designated safe area. In yet another example, the caregiver may specify that the user should be considered to be lost if the user is travelling erratically (e.g., wandering in circles). In various implementations, the caregiver may specify that locations are approved and/or not approved depending on conditions such as weather, temperature, geographic location and/or direction of travel, time of day, date and/or time, day of the week, month, season, and/or the like. For example, approved locations data may be obtained from the Locations field of the SWA request.

The SWA entry may be added to the list of SWA entries at 412. For example, identifiers of approved and/or not approved locations, geographic coordinates and/or boundaries of approved and/or not approved locations, conditions associated with approved and/or not approved locations, and/or the like may be added to the SWA Entries data store 930*e* using one or more SQL queries substantially in the following form:

INSERT INTO SWAEntries (EntryID, ApprovedLocations, EntryConditions)

VALUES (ID_Entry1, data regarding approved locations, conditions)

In another embodiment, the SWA request may be a notification by the SCGP that the user is wandering. For example, the SCGP may detect (e.g., via a GPS of the client of the user with memory problems) that the user is heading outside during a snowstorm. The user's designated safe area during a snowstorm may be limited to the user's residence. Accordingly, if the user is heading outside during a snowstorm, the SCGP may detect that the user is wandering. In one implementation, this may be detected by periodically checking approved locations data of entries in the SWA Entries data store 930*e* with regard to the user's current location and/or bearing.

An alert for the user may be produced at 420. For example, an alert (e.g., an audio message such as a beep; a notification on the screen of the user's smart phone via an SCGP app; a notification on the screen of the user's smart bracelet, such as a smart watch, via an SCGP app) may be produced for the user to inform the user that he is wandering. Directions may be recommended to the user at 422 to help the user return to an approved location (e.g., to the closest approved location). For example, directions may be provided via a map application component (e.g., utilizing Google Maps API).

A determination may be made at 424 whether the user follows the recommended directions. For example, if the user returns to a recommended approved location and/or acknowledges the alert (e.g., by pressing an OK button displayed by the SCGP app) the SCGP may conclude that the user followed the recommended directions. Otherwise, the SCGP may conclude that the user did not follow the recommended directions. In some implementations, the user may be given a specified time period (e.g., thirty seconds, five minutes) during which the user may return to the approved location. If the user does not return to the approved within the specified time period, the SCGP may conclude that the user did not follow the recommended directions. In some implementations, the SCGP may consider the user's movement during this determination. For example, if the SCGP determines (e.g., using the GPS of the user's smart phone) that the user is moving toward the approved location, the SCGP may conclude that the user followed the recommended directions and/or may give the user additional time to return to the approved location. Otherwise, the SCGP may conclude that the user did not follow the recommended directions.

If the SCGP determines that the user followed the recommended directions and/or returned to the approved location, the SCGP may avoid notifying the caregiver regarding the incident at 426. If the SCGP determines that the user did not follow the recommended directions and/or did not return to the approved location, the SCGP may notify the caregiver regarding the incident at 428. For example, the SCGP may send an alert to the caregiver's smart phone. In some implementations, the alert may include the location of the user. The SCGP may also facilitate tracking of the user at 430 (e.g., by showing the caregiver where the user is currently located and/or headed).

The SCGP may log the occurrence of the incident at 432. For example, the information associated with the incident (e.g., the identifier of the approved location that the user left, conditions associated with the incident, whether the user followed the directions and/or returned to the approved location) may be added to the SWA Logs data store 930*f*. In some implementations, the SCGP may utilize such information to provide the caregiver with useful reports. For example, such reports may facilitate understanding when the user is likely to get lost and/or wander (e.g., during cold/hot/rainy weather, during a particular time of day, when performing certain activities, in particular locations).

Figure 5:
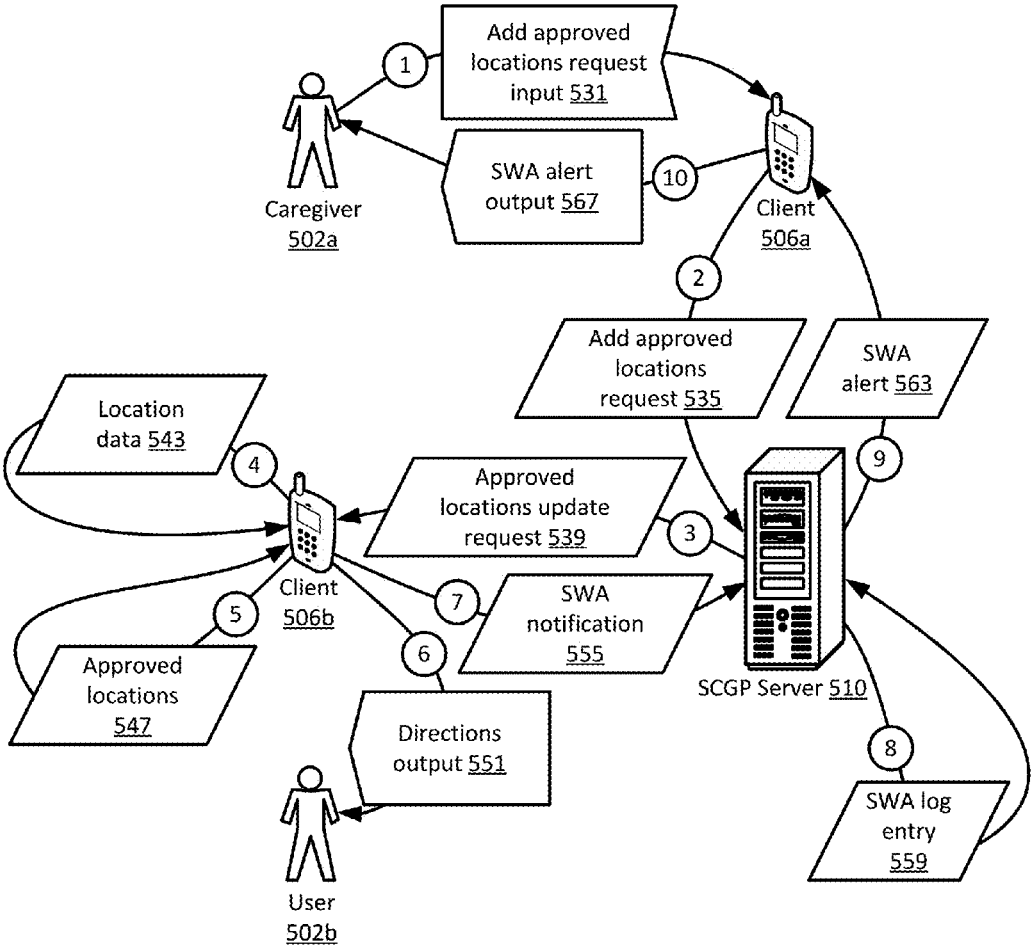
FIG. 5 shows a SWARH data flow diagram in one embodiment of the SCGP.

FIG. 5 shows a SWARH data flow diagram in one embodiment of the SCGP. FIG. 5 provides an example of how data may flow to, through, and/or from the SCGP when handling a SWA request. In FIG. 5, a caregiver 502*a* may utilize a client 506*a* (e.g., a smart phone, a laptop) to input a request to add approved locations 531. For example, the caregiver may utilize the client's touchscreen to add the approved locations via a SCGP mobile app. The caregiver may provide details such as the caregiver's username and/or password, an identifier of an approved location, geographic coordinates and/or boundaries of an approved location, conditions associated with an approved location, and/or the like.

The client may send a request to add the approved locations 535 to a SCGP server 510. For example, the add approved locations request may be in XML format and may include data such as the caregiver's username and/or password, an entry type (e.g., SWA entry), identifiers of approved locations, geographic coordinates and/or boundaries of approved locations, conditions associated with approved locations, the date and/or time of the request, and/or the like. In one implementation, the add approved locations request may be in XML format substantially in the following form:

```
<XML>
<AddApprovedLocationsRequest>
    <UserName>Caregiver_Username</UserName>
    <EntryType>ApprovedLocations</EntryType>
    <Locations>
        <Location>
            <LocationName>Park</LocationName>
            <LocationID>ID_Location1</LocationID>
            <Coordinates>geographic coordinates and
            boundaries</Coordinates>
            <Conditions>
                <Condition>Allowed temperature 50 to
                80 degrees</Condition>
                <Condition>Disallowed between 9pm and
                6am</Condition>
            </Conditions>
        </Location>
        <Location>
            <LocationName>Grocery Store</LocationName>
            ...
        </Location>
    </Locations>
</AddApprovedLocationsRequest>
</XML>
```

In one embodiment, the SCGP server may update its list of SWA entries based on the request.

The SCGP server may send a request to update the approved locations 539 to the client 506*b* (e.g., a smart phone, a smart bracelet) of the user with memory problems 502*b*. For example, the approved locations update request may be in XML format and may include data such as an entry type, identifiers of approved locations, geographic coordinates and/or boundaries of approved locations, conditions associated with approved locations, and/or the like. In one implementation, the approved locations update request may be in XML format substantially in the following form:

```
<XML>
<ApprovedLocationsUpdateRequest>
    <AddEntries>
        <Entry>
            <EntryID>ID_Entry1</EntryID>
            <EntryType>ApprovedLocations</EntryType>
            <LocationName>Park</LocationName>
            <LocationID>ID_Location1</LocationID>
```

-continued

```
            <Coordinates>geographic coordinates and
            boundaries</Coordinates>
            <Conditions>
                <Condition>Allowed temperature 50 to
                80 degrees</Condition>
                <Condition>Disallowed between 9pm and
                6am</Condition>
            </Conditions>
        </Entry>
        <Entry>
            <EntryID>ID_Entry2</EntryID>
            ...
        </Entry>
    </AddEntries>
    <DeleteEntries>
        <Entry>
            <EntryID>ID_Entry3</EntryID>
            ...
        </Entry>
    </DeleteEntries>
</ApprovedLocationsUpdateRequest>
</XML>
```

In one embodiment, the user's client may monitor the user's location status (e.g., safe, lost and/or wandering) via a mobile SCGP app that utilizes data regarding SWA entries.

The SCGP may periodically determine location data 543 associated with the user. For example, the SCGP may utilize the GPS of the user's client to determine the user's geographic location and/or direction of travel. The user's client may periodically analyze approved locations data 547 with respect to the location data to determine whether a condition indicating that the user is lost and/or wandering has been triggered. For example, approved locations data may include geographic coordinates and/or boundaries of approved and/or not approved locations, conditions associated with approved and/or not approved locations, and/or the like. Data regarding such conditions may be obtained based on the client's sensor readings (e.g., current temperature), based on information from third party providers (e.g., predicted weather), and/or the like.

If the SCGP concludes that such a condition signifying that the user is lost and/or wandering has been triggered, a directions output 551 may be provided to the user. For example, the directions output may be an audio beep and/or a vibrating alarm, and a textual message informing the user that the user seems to be lost and/or wandering, and directions to the nearest approved location (e.g., provided via a map application component).

An SWA notification 555 may be sent to the SCGP server to inform the SCGP server regarding the incident. For example, the SWA notification may be in XML format and may include data such as the identifier of the approved location that the user left, conditions associated with the incident, whether the user followed the directions and/or returned to the approved location, and/or the like. In one implementation, the SWA notification may be in XML format substantially in the following form:

```
<XML>
<SWANotification>
    <NotificationType>UserWandering</NotificationType>
    <DateTime>date and time of the incident</DateTime>
    <LastApprovedLocation>
        <LocationName>Park</LocationName>
        <LocationID>ID_Location1</LocationID>
        <Coordinates>
            geographic coordinates of the approved location
```

-continued

```
                that the user left
            </Coordinates>
        </LastApprovedLocation>
        <Conditions>
            <Condition>Snowing</Condition>
            <Condition>User entered an unapproved location</
            Condition>
        </Conditions>
        <DirectionsProvided>Yes</DirectionsProvided>
        <DirectionsFollowed>No</DirectionsFollowed>
</SWANotification>
</XML>
```

The SCGP server may generate an SWA log entry 559 recording such data (e.g., in the SWA Logs data store 930*f*). In one implementation, the data may be stored in a log file substantially in the following form:

EntryType|DateTime|Location|Conditions|Directions Provided|DirectionsFollowed

UserWandering|date/time|Park|Snowing|Yes|No

The SCGP server may send a SWA alert 563 to the caregiver's client. The SWA alert may be in XML format and may include data such as the identifier of the approved location that the user left, conditions associated with the incident, whether the user followed the directions and/or returned to the approved location, and/or the like. In one implementation, the SWA alert may be in XML format substantially in the following form:

```
<XML>
<SWAAlert>
    <ClientID>ID_Client2</ClientID>
    <AlertType>UserWandering</AlertType>
    <DateTime>date and time of the incident</DateTime>
    <LastApprovedLocation>
        <LocationName>Park</LocationName>
        <LocationID>ID_Location1</LocationID>
        <Coordinates>
            geographic coordinates of the approved location
            that the user left
        </Coordinates>
    </LastApprovedLocation>
    <Conditions>
        <Condition>Snowing</Condition>
        <Condition>User entered an unapproved location</
        Condition>
    </Conditions>
    <DirectionsProvided>Yes</DirectionsProvided>
    <DirectionsFollowed>No</DirectionsFollowed>
    <User>
        <Coordinates>geographic coordinates of user's
        location</Coordinates>
    </User>
</SWAAlert>
</XML>
```

The caregiver's client may provide a SWA alert output 567 to the caregiver. For example, the SWA alert output may include information such as a message indicating that the user is lost and/or wandering, the time and/or date when the incident occurred, the user's geographic location and/or direction of travel, whether the user followed the directions and/or returned to the approved location, and/or the like.

Figure 6:
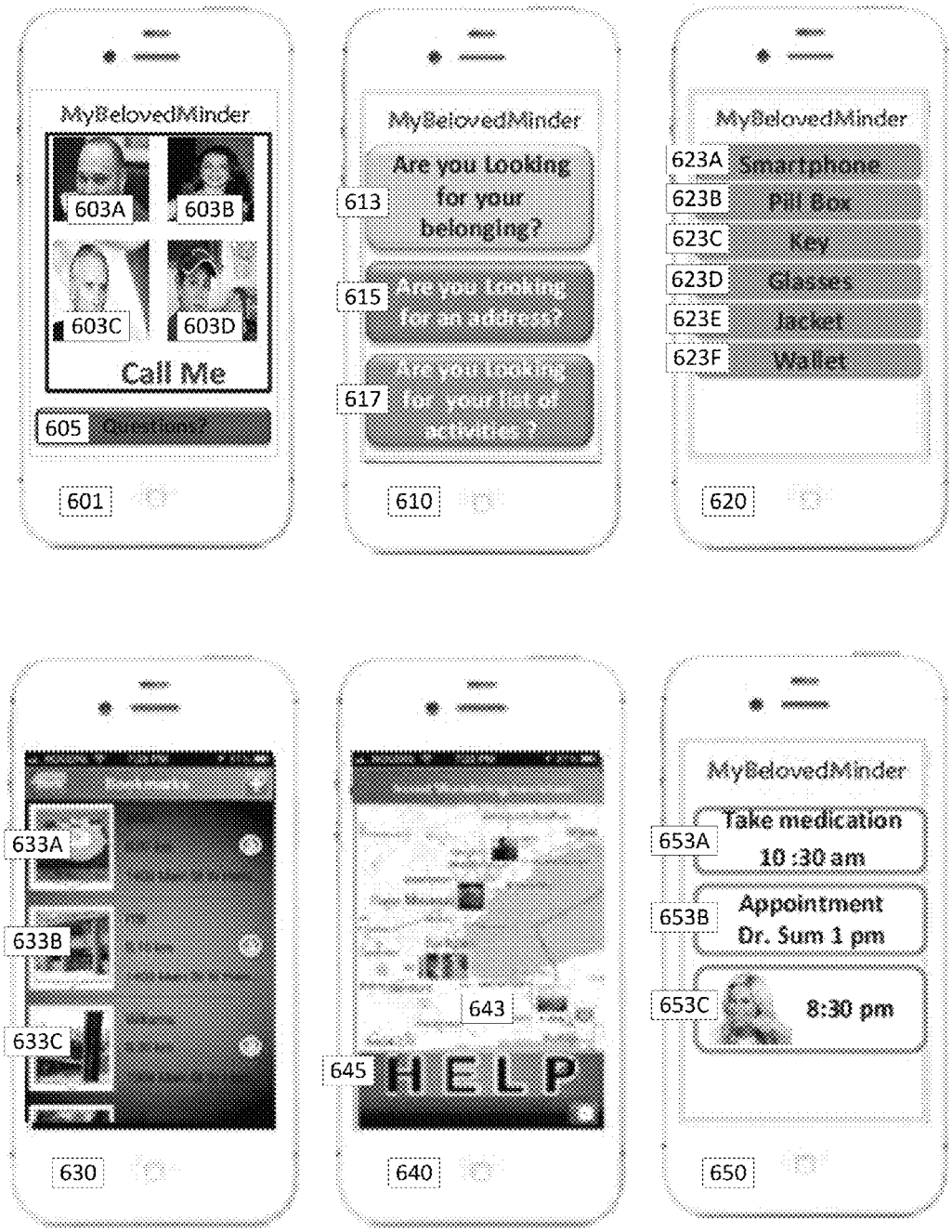
FIG. 6 shows a screen shot diagram illustrating an exemplary user app in one embodiment of the SCGP.

FIG. 6 shows a screen shot diagram illustrating an exemplary user app in one embodiment of the SCGP. FIG. 6, provides examples of how a SCGP mobile app may be utilized by a user with memory problems. Screen 601 shows that the user may have several ways to utilize the app. In one embodiment, the user may have one or more contacts (e.g., caretakers, family members) 603A-603D that the user may call. The app may facilitate calling the right contact by displaying a photo of each contact to the user. In one implementation, the user may tap the photo of a contact to call that contact. In another embodiment, the user may utilize the app to obtain various types of information. In one implementation, the user may actuate (e.g., tap, click on) the "Questions?" widget 605 to access information shown in screen 610.

Screen 610 shows that such information may include help with finding belongings, help finding an address, and a list of the user's activities. In one embodiment, the user may actuate the "Are you looking for your belonging?" widget 613 to obtain help with finding belongings. As shown in screen 620, actuating this widget may show the user a list of items that the app can help locate. In one implementation, such items may have smart tags to facilitate this feature. Actuating one of the item widgets 623A-623F may provide the user with an indication of the item's location. For example, if the user actuates the "Key" widget 623C, the smart tag attached to the user's keys may facilitate outputting a signal (e.g., an audio signal such as a beep, a visual signal such as a flashing light) to help the user locate the item. In another example, if the user actuates the "Pill Box" widget 623B, the app may inform the user where the item is typically located (e.g., the pillbox is usually located on the table in the dining room).

In another embodiment, the user may actuate the "Are you looking for an address?" widget 615 to obtain help finding an address. As shown in screen 630, actuating this widget may show the user a list of addresses that the app can help find. In one implementation, an address in the list may have a picture associated with it to help the user choose the right address (e.g., a picture of a park associated with address of the park, a picture of a grocery store associated with address of the grocery store). In another implementation, data such as associated name (e.g., park, grocery store), street address, distance from the user's current location, and/or the like may be displayed for addresses in the list. As shown in screen 640, actuating one of the address widgets 633A-633C may provide the user with additional help finding the selected address. For example, the map application component 643 may show the address on a map (e.g., by itself, in relation to other addresses in the list). In another example, the map application component 643 may provide turn-by-turn navigation (e.g., using a GPS) from the user's current location to the address. If the user is having difficulty finding an address, the user may actuate the "Help" widget 645 and the app may facilitate connecting the user to the user's caregiver (e.g., via a phone call, via video chat).

In yet another embodiment, the user may actuate the "Are you looking for your list of activities?" widget 617 to display a list of the user's activities (e.g., for today). As shown in screen 650, the user's activities may include activities 653A-653C. An activity may be associated with a time when the activity should be performed. For example, activity 653A indicates that the user should take medication at 10:30 am (e.g., if the user's smart pillbox indicates that the user did not take medication by 10:30 am, a reminder may be provided to the user and/or an alert may be sent to the user's caregiver). In various implementations, an activity in the list may be shown as text (e.g., appointment with Dr. Sum), image (e.g., a picture of a person brushing her teeth), video (e.g., an animation showing opening a pillbox), and/or the like.

Figure 7A:
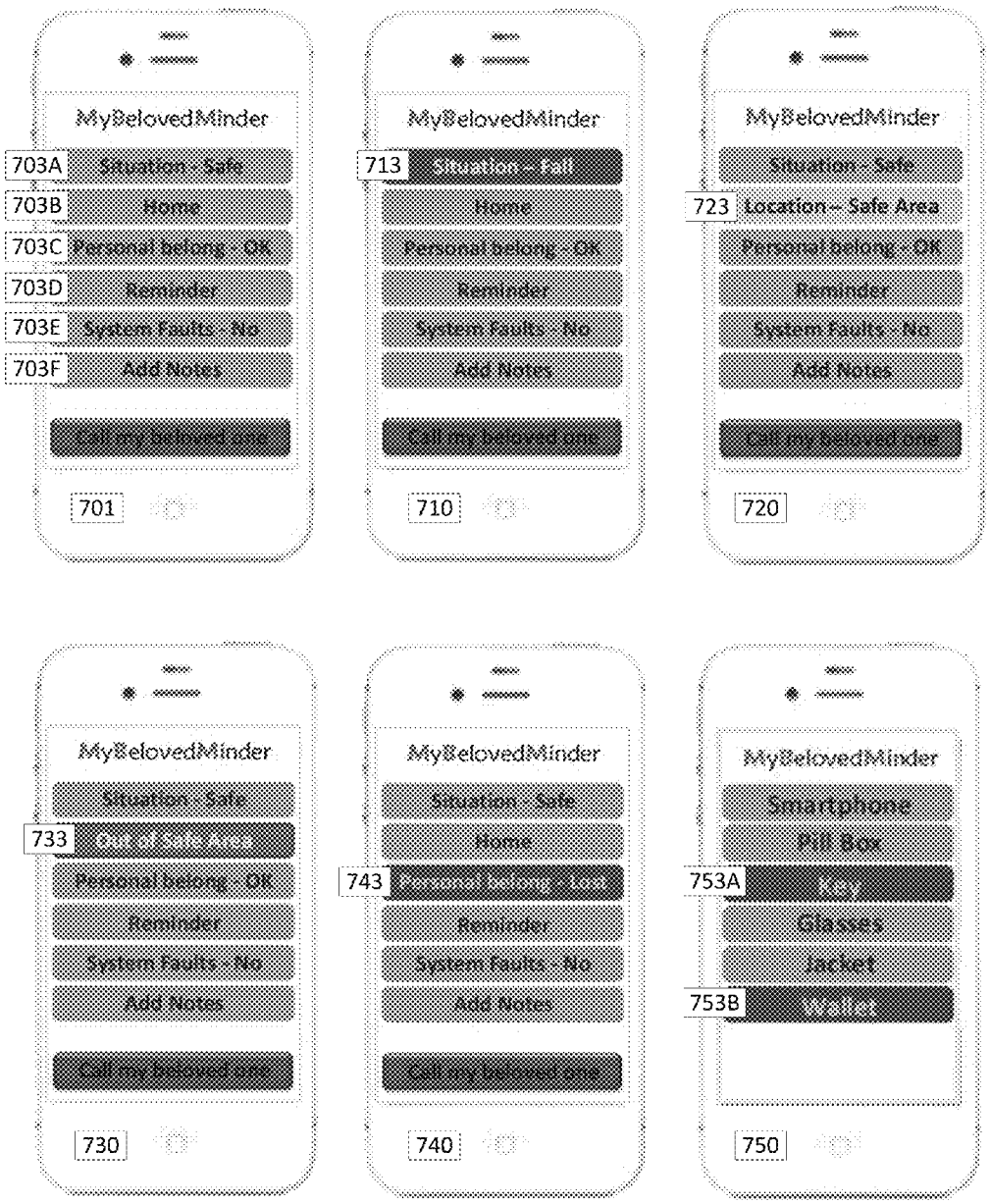
FIGS. 7A and 7B show screen shot diagrams illustrating an exemplary caregiver app in one embodiment of the SCGP.
Figure 7B:
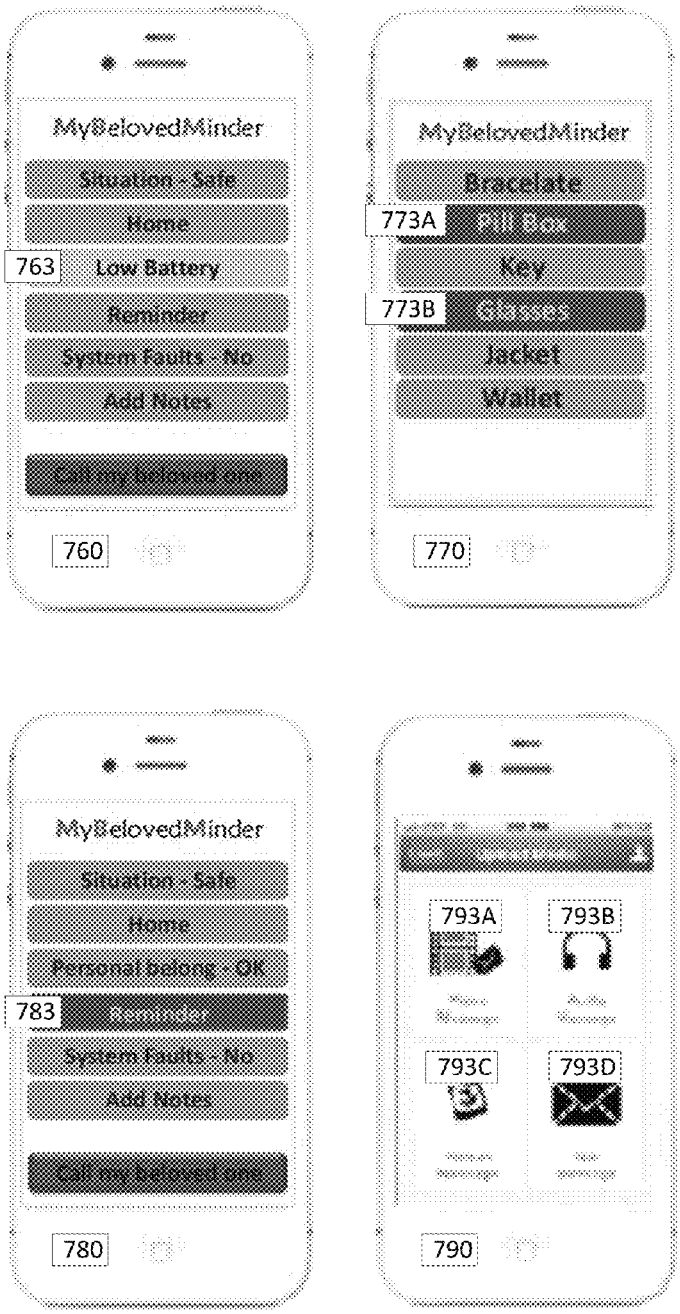

FIGS. 7A and 7B show screen shot diagrams illustrating an exemplary caregiver app in one embodiment of the SCGP. FIGS. 7A and 7B provide examples of how a SCGP mobile app may be utilized by a user's caregiver. Screen 701 shows that the caregiver may have several ways to utilize the app via widgets 703A-703F, such as to track whether the user is safe, to track whether the user is lost and/or wandering, to track whether the user lost and/or forgot an item, to send the user a reminder, and/or the like.

In one embodiment, the app may facilitate tracking whether the user is safe. If the user is safe, the "Situation" widget 703A may display a message indicating that the user is safe (e.g., Situation—Safe). As shown in screen 710, if something happens, the "Situation" widget 713 may display a message indicating that something happened (e.g., Situation—Fall). For example, the app may inform the caregiver that the user fell (e.g., based on accelerometer data from the fall detector of the user's smart bracelet). In another example, the app may inform the caregiver that there is an emergency situation (e.g., based on heart rate monitoring data from the user's smart bracelet). In yet another example, the app may inform the caregiver if the user pushed a personal help button on the user's smart bracelet. In some implementations, an alert (e.g., an audio message, a notification) may be generated to alert the caregiver that something happened. In some implementations, the caregiver may actuate the "Situation" widget 713 to view additional information regarding the situation (e.g., the date and/or time when the situation occurred, the location of the user).

In another embodiment, the app may facilitate tracking whether the user is lost and/or wandering. The "Location" widget 703B may inform the caregiver of the user's location. In one implementation, there may be a plurality of location types (e.g., home, safe area, outside of safe area) where the user may be located. For example, the "Location" widget 703B indicates that the user is at home. In another example, as shown in screen 720, the "Location" widget 723 indicates that the user is in a safe area (e.g., an approved location such as a park during approved hours). In yet another example, as shown in screen 730, the "Location" widget 733 indicates that the user is outside of a safe area (e.g., the user may be lost and/or wandering). In some implementations, an alert may be generated to alert the caregiver that the user is outside of a safe area. In some implementations, the caregiver may actuate the "Location" widget 733 to track the user's location.

In yet another embodiment, the app may facilitate tracking whether the user lost and/or forgot an item. If the user's items are accounted for, the "Personal Belongings" widget 703C may display a message indicating that the user's items are accounted for (e.g., Personal belongings—OK). As shown in screen 740, if the user lost and/or forgot an item, the "Personal Belongings" widget 743 may display a message indicating that an item was lost and/or forgotten. In some implementations, an alert may be generated to alert the caregiver that the user lost and/or forgot an item. As shown in screen 750, actuating this widget may show the caregiver which items 753A-753B the user lost and/or forgot. In some implementations, the caregiver may actuate an item widget to get additional information regarding an item. For example, if the caregiver actuates the "Wallet" item widget 753B, the app may inform the caregiver when and/or where the user lost his wallet. In some implementations, an item may have a smart tag to facilitate tracking the item. As shown in screen 760, if the battery in an item's smart tag is low, the "Personal Belongings" widget 763 may display a message indicating that the battery is low. In some implementations, an alert may be generated to alert the caregiver that the battery is low. As shown in screen 770, actuating this widget may show the caregiver which of the user's items 773A-773B have smart tags with low battery.

In yet another embodiment, the app may facilitate sending the user a reminder from the caregiver. For example, the caregiver may actuate the "Reminder" widget 703D to send the user a reminder. In another example, as shown in screen 780, the app may prompt the caregiver to actuate the "Reminder" widget 783 to send a reminder to the user (e.g., if the user forgot to open his smart pillbox to take his medicine). In one implementation, as shown in screen 790, the caregiver may actuate widget 793A to send a reminder via a video message, may actuate widget 793B to send a reminder via an audio message, may actuate widget 793C to send a reminder via a picture message, or may actuate widget 793D to send a reminder via a text message.

In yet another embodiment, the app may inform the caregiver of any system faults (e.g., hardware failures) via the "System Faults" widget 703E. In yet another embodiment, the app may facilitate adding a note via the "Add Notes" widget 703F (e.g., the app may facilitate recording the date and/or time, conditions, and/or the like of the situation associated with the note).

Figure 8:
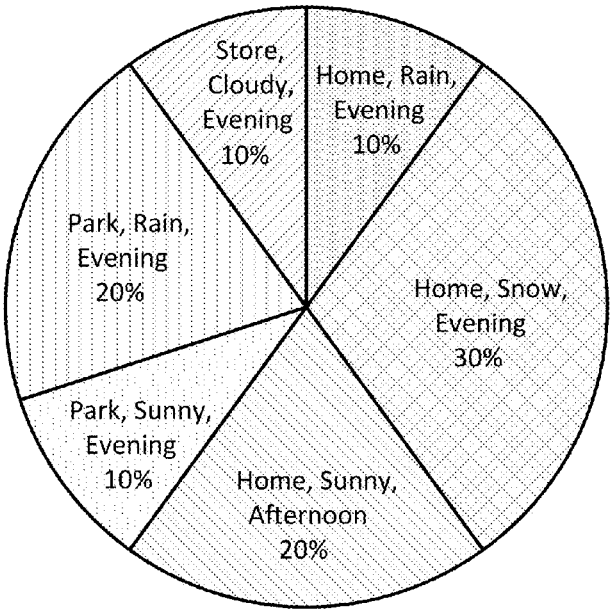
FIG. 8 shows a screen shot diagram illustrating exemplary reports in one embodiment of the SCGP.

FIG. 8 shows a screen shot diagram illustrating exemplary reports in one embodiment of the SCGP. FIG. 8, provides examples of reports that may be generated by the SCGP for a user's caregiver. In one embodiment, the SCGP may generate a lost items report 810 to facilitate understanding when the user is likely to lose and/or forget items. The caregiver may use the range widget 813 to select a date range for which analysis of data (e.g., stored in the SAP Logs data store 930*d*) should be performed. In one implementation, the report may show which item was lost 817, how many times the item was lost 821, how many times the item was lost as a percentage of the total number of lost items 825, conditions such as weather 829 and time of day 833 associated with the incident, and/or the like. For example, the report shows that the user is likely to forget the user's umbrella in the mornings and afternoons, when rain is predicted to occur, but it has not started raining yet.

In another embodiment, the SCGP may generate a user wandering report 850 to facilitate understanding when the user is likely to get lost and/or wander. The caregiver may utilize the SCGP to analyze data (e.g., stored in the SWA Logs data store 930*f*) and generate a report in a chart format. In one implementation, the report may show the last approved location that the user left and/or was heading toward, conditions such as weather and time of day associated with the incident, how many times the user became lost as a percentage of the total number of times the user became lost, and/or the like. For example, the report shows that the user is likely to get lost when the user leaves home to go somewhere in the evenings, when it is snowing.

Detailed Description of the SCGP Coordinator

Figure 9:
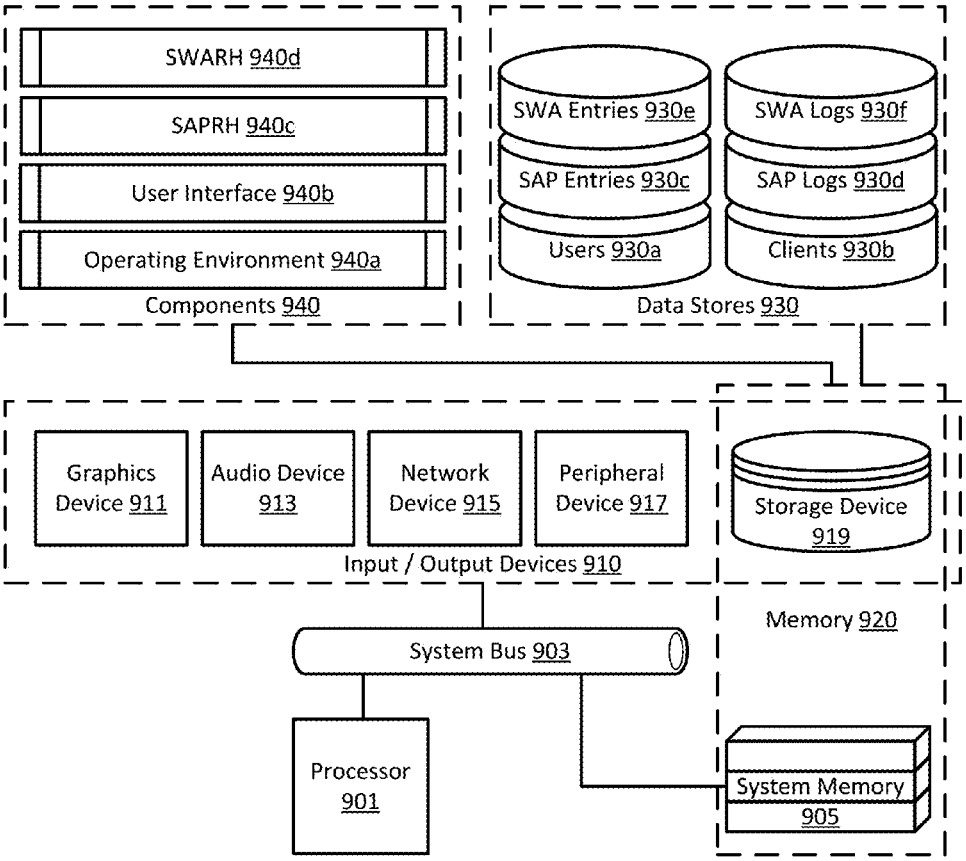
FIG. 9 shows a block diagram illustrating an exemplary SCGP coordinator in one embodiment of the SCGP.

FIG. 9 shows a block diagram illustrating an exemplary SCGP coordinator in one embodiment of the SCGP. The SCGP coordinator facilitates the operation of the SCGP via a computer system (e.g., one or more cloud computing systems, grid computing systems, virtualized computer systems, mainframe computers, servers, clients, nodes, desktops, mobile devices such as smart phones, cellular phones, tablets, personal digital assistants (PDAs), and/or the like, embedded computers, dedicated computers, a system on a chip (SOC)). For example, the SCGP coordinator may receive, obtain, aggregate, process, generate, store, retrieve, send, delete, input, output, and/or the like data (including program data and program instructions); may execute program instructions; may communicate with computer systems, with nodes, with users, and/or the like. In various embodiments, the SCGP coordinator may comprise a standalone computer system, a distributed computer system, a node in a computer network (i.e., a network of computer systems organized in a topology), a network of SCGP coordinators, and/or the like. It is to be understood that the SCGP coordinator and/or the various SCGP coordinator elements (e.g., processor, system bus, memory, input/output devices) may be organized in any number of ways (i.e., using any number and configuration of computer systems, computer networks, nodes, SCGP coordinator elements, and/or the like) to facilitate SCGP operation. Furthermore, it is to be understood that the various SCGP coordinator computer systems, SCGP coordinator computer networks, SCGP coordinator nodes, SCGP coordinator elements, and/or the like may communicate among each other in any number of ways to facilitate SCGP operation. As used in this disclosure, the term "user" refers generally to people and/or computer systems that interact with the SCGP; the term "server" refers generally to a computer system, a program, and/or a combination thereof that handles requests and/or responds to requests from clients via a computer network; the term "client" refers generally to a computer system, a program, a user, and/or a combination thereof that generates requests and/or handles responses from servers via a computer network; the term "node" refers generally to a server, to a client, and/or to an intermediary computer system, program, and/or a combination thereof that facilitates transmission of and/or handling of requests and/or responses.

The SCGP coordinator includes a processor 901 that executes program instructions (e.g., SCGP program instructions). In various embodiments, the processor may be a general purpose microprocessor (e.g., a central processing unit (CPU)), a dedicated microprocessor (e.g., a graphics processing unit (GPU), a physics processing unit (PPU), a digital signal processor (DSP), a network processor, and/or the like), an external processor, a plurality of processors (e.g., working in parallel, distributed, and/or the like), a microcontroller (e.g., for an embedded system), and/or the like. The processor may be implemented using integrated circuits (ICs), application-specific integrated circuits (ASICs), field-programmable gate arrays (FPGAs), and/or the like. In various implementations, the processor may comprise one or more cores, may include embedded elements (e.g., a coprocessor such as a math coprocessor, a cryptographic coprocessor, a physics coprocessor, and/or the like, registers, cache memory, software), may be synchronous (e.g., using a clock signal) or asynchronous (e.g., without a central clock), and/or the like. For example, the processor may be an AMD FX processor, an AMD Opteron processor, an AMD Geode LX processor, an Intel Core i7 processor, an Intel Xeon processor, an Intel Atom processor, an ARM Cortex processor, an IBM PowerPC processor, a CC2540 processor, and/or the like.

The processor may be connected to system memory 905 via a system bus 903. The system bus may interconnect these and/or other elements of the SCGP coordinator via electrical, electronic, optical, wireless, and/or the like communication links (e.g., the system bus may be integrated into a motherboard that interconnects SCGP coordinator elements and provides power from a power supply). In various embodiments, the system bus may comprise one or more control buses, address buses, data buses, memory buses, peripheral buses, and/or the like. In various implementations, the system bus may be a parallel bus, a serial bus, a daisy chain design, a hub design, and/or the like. For example, the system bus may comprise a front-side bus, a back-side bus, AMD's HyperTransport, Intel's QuickPath Interconnect, a peripheral component interconnect (PCI) bus, an accelerated graphics port (AGP) bus, a PCI Express bus, a low pin count (LPC) bus, a universal serial bus (USB), and/or the like. The system memory, in various embodiments, may comprise registers, cache memory (e.g., level one, level two, level three), read only memory (ROM) (e.g., BIOS, flash memory), random access memory (RAM) (e.g., static RAM (SRAM), dynamic RAM (DRAM), error-correcting code (ECC) memory), and/or the like. The system memory may be discreet, external, embedded, integrated into a CPU, and/or the like. The processor may access, read from, write to, store in, erase, modify, and/or the like, the system memory in accordance with program instructions (e.g., SCGP program instructions) executed by the processor. The system memory may facilitate accessing, storing, retrieving, modifying, deleting, and/or the like data (e.g., SCGP data) by the processor.

In various embodiments, input/output devices 910 may be connected to the processor and/or to the system memory, and/or to one another via the system bus.

In some embodiments, the input/output devices may include one or more graphics devices 911. The processor may make use of the one or more graphic devices in accordance with program instructions (e.g., SCGP program instructions) executed by the processor. In one implementation, a graphics device may be a video card that may obtain (e.g., via a connected video camera), process (e.g., render a frame), output (e.g., via a connected monitor, television, and/or the like), and/or the like graphical (e.g., multimedia, video, image, text) data (e.g., SCGP data). A video card may be connected to the system bus via an interface such as PCI, AGP, PCI Express, USB, PC Card, ExpressCard, and/or the like. A video card may use one or more graphics processing units (GPUs), for example, by utilizing AMD's CrossFireX and/or NVIDIA's SLI technologies. A video card may be connected via an interface (e.g., video graphics array (VGA), digital video interface (DVI), Mini-DVI, Micro-DVI, high-definition multimedia interface (HDMI), DisplayPort, Thunderbolt, composite video, S-Video, component video, and/or the like) to one or more displays (e.g., cathode ray tube (CRT), liquid crystal display (LCD), touchscreen, and/or the like) that display graphics. For example, a video card may be an AMD Radeon HD 6990, an ATI Mobility Radeon HD 5870, an AMD FirePro V9800P, an AMD Radeon E6760 MXM V3.0 Module, an NVIDIA GeForce GTX 590, an NVIDIA GeForce GTX 580M, an Intel HD Graphics 3000, and/or the like. In another implementation, a graphics device may be a video capture board that may obtain (e.g., via coaxial cable), process (e.g., overlay with other graphical data), capture, convert (e.g., between different formats, such as MPEG2 to H.264), and/or the like graphical data. A video capture board may be and/or include a TV tuner, may be compatible with a variety of broadcast signals (e.g., NTSC, PAL, ATSC, QAM) may be a part of a video card, and/or the like. For example, a video capture board may be an ATI All-in-Wonder HD, a Hauppauge ImpactVBR 01381, a Hauppauge WinTV-HVR-2250, a Hauppauge Colossus 01414, and/or the like. A graphics device may be discreet, external, embedded, integrated into a CPU, and/or the like. A graphics device may operate in combination with other graphics devices (e.g., in parallel) to provide improved capabilities, data throughput, color depth, and/or the like.

In some embodiments, the input/output devices may include one or more audio devices 913. The processor may make use of the one or more audio devices in accordance with program instructions (e.g., SCGP program instructions) executed by the processor. In one implementation, an audio device may be a sound card that may obtain (e.g., via a connected microphone), process, output (e.g., via connected speakers), and/or the like audio data (e.g., SCGP data). A sound card may be connected to the system bus via an interface such as PCI, PCI Express, USB, PC Card, ExpressCard, and/or the like. A sound card may be connected via an interface (e.g., tip sleeve (TS), tip ring sleeve (TRS), RCA, TOSLINK, optical) to one or more amplifiers, speakers (e.g., mono, stereo, surround sound), subwoofers, digital musical instruments, and/or the like. For example, a sound card may be an Intel AC'97 integrated codec chip, an Intel HD Audio integrated codec chip, a Creative Sound Blaster X-Fi Titanium HD, a Creative Sound Blaster X-Fi Go! Pro, a Creative Sound Blaster Recon 3D, a Turtle Beach Riviera, a Turtle Beach Amigo II, and/or the like. An audio device may be discreet, external, embedded, integrated into a motherboard, and/or the like. An audio device may operate in combination with other audio devices (e.g., in parallel) to provide improved capabilities, data throughput, audio quality, and/or the like.

In some embodiments, the input/output devices may include one or more network devices 915. The processor may make use of the one or more network devices in accordance with program instructions (e.g., SCGP program instructions) executed by the processor. In one implementation, a network device may be a network card that may obtain (e.g., via a Category 5 Ethernet cable), process, output (e.g., via a wireless antenna), and/or the like network data (e.g., SCGP data). A network card may be connected to the system bus via an interface such as PCI, PCI Express, USB, FireWire, PC Card, ExpressCard, and/or the like. A network card may be a wired network card (e.g., 10/100/1000, optical fiber), a wireless network card (e.g., Wi-Fi 802.11a/b/g/n/ac/ad, Bluetooth, Bluetooth Low Energy (BLE), Near Field Communication (NFC), TransferJet), a modem (e.g., dialup telephone-based, asymmetric digital subscriber line (ADSL), cable modem, power line modem, wireless modem based on cellular protocols such as high speed packet access (HSPA), evolution-data optimized (EV-DO), global system for mobile communications (GSM), worldwide interoperability for microwave access (WiMax), long term evolution (LTE), and/or the like, satellite modem, FM radio modem, radio-frequency identification (RFID) modem, infrared (IR) modem), and/or the like. For example, a network card may be an Intel EXPI9301CT, an Intel EXPI9402PT, a LINKSYS USB300M, a BUFFALO WLI-UC-G450, a Rosewill RNX-MiniN1, a TRENDnet TEW-623PI, a Rosewill RNX-N180UBE, an ASUS USB-BT211, a MOTOROLA SB6120, a U.S. Robotics USR5686G, a Zoom 5697-00-00F, a TRENDnet TPL-401E2K, a D-Link DHP-W306AV, a StarTech ET91000SC, a Broadcom BCM20791, a Broadcom InConcert BCM4330, a Broadcom BCM4360, an LG VL600, a Qualcomm MDM9600, a Toshiba TC35420 TransferJet device, and/or the like. A network device may be discreet, external, embedded, integrated into a motherboard, and/or the like. A network device may operate in combination with other network devices (e.g., in parallel) to provide improved data throughput, redundancy, and/or the like. For example, protocols such as link aggregation control protocol (LACP) based on IEEE 802.3AD-2000 or IEEE 802.1AX-2008 standards may be used. A network device may be used to connect to a local area network (LAN), a wide area network (WAN), a metropolitan area network (MAN), a personal area network, the Internet, an intranet, a Bluetooth network, a BLE network, an NFC network, a Wi-Fi network, a cellular network, and/or the like.

In some embodiments, the input/output devices may include one or more peripheral devices 917. The processor may make use of the one or more peripheral devices in accordance with program instructions (e.g., SCGP program instructions) executed by the processor. In various implementations, a peripheral device may be a digital camera, a video camera, a webcam, an electronically moveable pan tilt zoom (PTZ) camera, a monitor, a touchscreen display, active shutter 3D glasses, head-tracking 3D glasses, a remote control, an audio line-in, an audio line-out, a microphone, headphones, speakers, a subwoofer, a router, a hub, a switch, a firewall, an antenna, a keyboard, a mouse, a trackpad, a trackball, a digitizing tablet, a stylus, a joystick, a gamepad, a game controller, a force-feedback device, a laser, sensors (e.g., proximity sensor, rangefinder, ambient temperature sensor, ambient light sensor, humidity sensor, an accelerometer, a gyroscope, a motion sensor, an olfaction sensor, a biosensor, a chemical sensor, a magnetometer, a radar, a sonar, a location sensor such as global positioning system (GPS), Galileo, GLONASS, and/or the like), a printer, a fax, a scanner, a copier, a card reader, and/or the like. A peripheral device may be connected to the system bus via an interface such as PCI, PCI Express, USB, FireWire, VGA, DVI, Mini-DVI, Micro-DVI, HDMI, DisplayPort, Thunderbolt, composite video, S-Video, component video, PC Card, ExpressCard, serial port, parallel port, PS/2, TS, TRS, RCA, TOSLINK, network connection (e.g., wired such as Ethernet, optical fiber, and/or the like, wireless such as Wi-Fi, Bluetooth, BLE, NFC, cellular, and/or the like), a connector of another input/output device, and/or the like. A peripheral device may be discreet, external, embedded, integrated (e.g., into a processor, into a motherboard), and/or the like. A peripheral device may operate in combination with other peripheral devices (e.g., in parallel) to provide the SCGP coordinator with a variety of input, output and processing capabilities.

In some embodiments, the input/output devices may include one or more storage devices 919. The processor may access, read from, write to, store in, erase, modify, and/or the like a storage device in accordance with program instructions (e.g., SCGP program instructions) executed by the processor. A storage device may facilitate accessing, storing, retrieving, modifying, deleting, and/or the like data (e.g., SCGP data) by the processor. In one implementation, the processor may access data from the storage device directly via the system bus. In another implementation, the processor may access data from the storage device by instructing the storage device to transfer the data to the system memory and accessing the data from the system memory. In various embodiments, a storage device may be a hard disk drive (HDD), a solid-state drive (SSD), a floppy drive using diskettes, an optical disk drive (e.g., compact disk (CD-ROM) drive, CD-Recordable (CD-R) drive, CD-Rewriteable (CD-RW) drive, digital versatile disc (DVD-ROM) drive, DVD-R drive, DVD-RW drive, Blu-ray disk (BD) drive) using an optical medium, a magnetic tape drive using a magnetic tape, a memory card (e.g., a USB flash drive, a compact flash (CF) card, a secure digital extended capacity (SDXC) card), a network attached storage (NAS), a direct-attached storage (DAS), a storage area network (SAN), other processor-readable physical mediums, and/or the like. A storage device may be connected to the system bus via an interface such as PCI, PCI Express, USB, FireWire, PC Card, ExpressCard, integrated drive electronics (IDE), serial advanced technology attachment (SATA), external SATA (eSATA), small computer system interface (SCSI), serial attached SCSI (SAS), fibre channel (FC), network connection (e.g., wired such as Ethernet, optical fiber, and/or the like; wireless such as Wi-Fi, Bluetooth, BLE, NFC, cellular, and/or the like), and/or the like. A storage device may be discreet, external, embedded, integrated (e.g., into a motherboard, into another storage device), and/or the like. A storage device may operate in combination with other storage devices to provide improved capacity, data throughput, data redundancy, and/or the like. For example, protocols such as redundant array of independent disks (RAID) (e.g., RAID 0 (striping), RAID 1 (mirroring), RAID 5 (striping with distributed parity), hybrid RAID), just a bunch of drives (JBOD), and/or the like may be used. In another example, virtual and/or physical drives may be pooled to create a storage pool. In yet another example, an SSD cache may be used with a HDD to improve speed.

Together and/or separately the system memory 905 and the one or more storage devices 919 may be referred to as memory 920 (i.e., physical memory).

SCGP memory 920 contains processor-operable (e.g., accessible) SCGP data stores 930. Data stores 930 comprise data that may be used (e.g., by the SCGP) via the SCGP coordinator. Such data may be organized using one or more data formats such as a database (e.g., a relational database with database tables, an object-oriented database, a graph database, a hierarchical database), a flat file (e.g., organized into a tabular format), a binary file (e.g., a GIF file, an MPEG-4 file), a structured file (e.g., an HTML file, an XML file), a text file, and/or the like. Furthermore, data may be organized using one or more data structures such as an array, a queue, a stack, a set, a linked list, a map, a tree, a hash, a record, an object, a directed graph, and/or the like. In various embodiments, data stores may be organized in any number of ways (i.e., using any number and configuration of data formats, data structures, SCGP coordinator elements, and/or the like) to facilitate SCGP operation. For example, SCGP data stores may comprise data stores 930*a-f* implemented as one or more databases. A users data store 930*a* may be a collection of database tables that include fields such as UserID, UserName, UserPreferences, AssociatedCaregiver, AssociatedDependentUser, and/or the like. A clients data store 930*b* may be a collection of database tables that include fields such as ClientID, ClientName, ClientDeviceType, ClientScreenResolution, and/or the like. A SAP Entries data store 930*c* may be a collection of database tables that include fields such as EntryID, ItemName, SmartTagID, EntryConditions, and/or the like. A SAP Logs data store 930*d* may be a collection of database tables that include fields such as IncidentID, ForgottenItemName, ForgottenItemSmartTagID, IncidentConditions, WasItemRetrieved, and/or the like. A SWA Entries data store 930*e* may be a collection of database tables that include fields such as EntryID, ApprovedLocations, UnapprovedLocations, EntryConditions, and/or the like. A SWA Logs data store 930*f* may be a collection of database tables that include fields such as IncidentID, IncidentLocation, IncidentConditions, WereDirectionsFollowed, and/or the like. The SCGP coordinator may use data stores 930 to keep track of inputs, parameters, settings, variables, records, outputs, and/or the like.

SCGP memory 920 contains processor-operable (e.g., executable) SCGP components 940. Components 940 comprise program components (including program instructions and any associated data stores) that are executed (e.g., by the SCGP) via the SCGP coordinator (i.e., via the processor) to transform SCGP inputs into SCGP outputs. It is to be understood that the various components and their subcomponents, capabilities, applications, and/or the like may be organized in any number of ways (i.e., using any number and configuration of components, subcomponents, capabilities, applications, SCGP coordinator elements, and/or the like) to facilitate SCGP operation. Furthermore, it is to be understood that the various components and their subcomponents, capabilities, applications, and/or the like may communicate among each other in any number of ways to facilitate SCGP operation. For example, the various components and their subcomponents, capabilities, applications, and/or the like may be combined, integrated, consolidated, split up, distributed, and/or the like in any number of ways to facilitate SCGP operation. In another example, a single or multiple instances of the various components and their subcomponents, capabilities, applications, and/or the like may be instantiated on each of a single SCGP coordinator node, across multiple SCGP coordinator nodes, and/or the like.

In various embodiments, program components may be developed using one or more programming languages, techniques, tools, and/or the like such as 8051, an assembly language, Ada, BASIC, C, C++, C#, COBOL, Fortran, Java, LabVIEW, Lisp, Mathematica, MATLAB, OCaml, PL/I, Smalltalk, Visual Basic for Applications (VBA), HTML, XML, CSS, JavaScript, JavaScript Object Notation (JSON), PHP, Perl, Ruby, Python, Asynchronous JavaScript and XML (AJAX), Simple Object Access Protocol (SOAP), SSL, ColdFusion, Microsoft .NET, Apache modules, Adobe Flash, Adobe AIR, Microsoft Silverlight, Windows PowerShell, batch files, Tcl, graphical user interface (GUI) toolkits, SQL, database adapters, web application programming interfaces (APIs), application server extensions, integrated development environments (IDEs), libraries (e.g., object libraries, class libraries, remote libraries), remote procedure calls (RPCs), Common Object Request Broker Architecture (CORBA), and/or the like.

In some embodiments, components 940 may include an operating environment component 940*a*. The operating environment component may facilitate operation of the SCGP via various subcomponents.

In some implementations, the operating environment component may include an operating system subcomponent. The operating system subcomponent may provide an abstraction layer that facilitates the use of, communication among, common services for, interaction with, security of, and/or the like of various SCGP coordinator elements, components, data stores, and/or the like.

In some embodiments, the operating system subcomponent may facilitate execution of program instructions (e.g., SCGP program instructions) by the processor by providing process management capabilities. For example, the operating system subcomponent may facilitate the use of multiple processors, the execution of multiple processes, multitasking, and/or the like.

In some embodiments, the operating system subcomponent may facilitate the use of memory by the SCGP. For example, the operating system subcomponent may allocate and/or free memory, facilitate memory addressing, provide memory segmentation and/or protection, provide virtual memory capability, facilitate caching, and/or the like. In another example, the operating system subcomponent may include a file system (e.g., File Allocation Table (FAT), New Technology File System (NTFS), Hierarchical File System Plus (HFS+), Universal Disk Format (UDF), Linear Tape File System (LTFS)) to facilitate storage, retrieval, deletion, aggregation, processing, generation, and/or the like of data.

In some embodiments, the operating system subcomponent may facilitate operation of and/or processing of data for and/or from input/output devices. For example, the operating system subcomponent may include one or more device drivers, interrupt handlers, file systems, and/or the like that allow interaction with input/output devices.

In some embodiments, the operating system subcomponent may facilitate operation of the SCGP coordinator as a node in a computer network by providing support for one or more communications protocols. For example, the operating system subcomponent may include support for the internet protocol suite (i.e., Transmission Control Protocol/Internet Protocol (TCP/IP)) of network protocols such as TCP, IP, User Datagram Protocol (UDP), Mobile IP, and/or the like. In another example, the operating system subcomponent may include support for security protocols (e.g., Wired Equivalent Privacy (WEP), Wi-Fi Protected Access (WPA), WPA2) for wireless computer networks. In yet another example, the operating system subcomponent may include support for virtual private networks (VPNs).

In some embodiments, the operating system subcomponent may facilitate security of the SCGP coordinator. For example, the operating system subcomponent may provide services such as authentication, authorization, audit, network intrusion-detection capabilities, firewall capabilities, antivirus capabilities, and/or the like.

In some embodiments, the operating system subcomponent may facilitate user interaction with the SCGP by providing user interface elements that may be used by the SCGP to generate a user interface. In one implementation, such user interface elements may include widgets (e.g., windows, dialog boxes, scrollbars, menu bars, tabs, ribbons, menus, buttons, text boxes, checkboxes, combo boxes, drop-down lists, list boxes, radio buttons, sliders, spinners, grids, labels, progress indicators, icons, tooltips, and/or the like) that may be used to obtain input from and/or provide output to the user. For example, such widgets may be used via a widget toolkit such as Microsoft Foundation Classes (MFC), Apple Cocoa Touch, Java Swing, GTK+, Qt, Yahoo! User Interface Library (YUI), and/or the like. In another implementation, such user interface elements may include sounds (e.g., event notification sounds stored in MP3 file format), animations, vibrations, and/or the like that may be used to inform the user regarding occurrence of various events. For example, the operating system subcomponent may include a user interface such as Windows Aero, Mac OS X Aqua, GNOME Shell, KDE Plasma Workspaces (e.g., Plasma Desktop, Plasma Netbook, Plasma Contour, Plasma Mobile), and/or the like.

In various embodiments the operating system subcomponent may comprise a single-user operating system, a multi-user operating system, a single-tasking operating system, a multitasking operating system, a single-processor operating system, a multiprocessor operating system, a distributed operating system, an embedded operating system, a real-time operating system, and/or the like. For example, the operating system subcomponent may comprise an operating system such as UNIX, LINUX, IBM i, Sun Solaris, Microsoft Windows Server, Microsoft DOS, Microsoft Windows 7, Apple Mac OS X, Apple iOS, Android, Symbian, Windows Phone 7, Blackberry QNX, and/or the like.

In some implementations, the operating environment component may include a database subcomponent. The database subcomponent may facilitate SCGP capabilities such as storage, analysis, retrieval, access, modification, deletion, aggregation, generation, and/or the like of data (e.g., the use of data stores 930). The database subcomponent may make use of database languages (e.g., Structured Query Language (SQL), XQuery), stored procedures, triggers, APIs, and/or the like to provide these capabilities. In various embodiments the database subcomponent may comprise a cloud database, a data warehouse, a distributed database, an embedded database, a parallel database, a real-time database, and/or the like. For example, the database subcomponent may comprise a database such as Microsoft SQL Server, Microsoft Access, MySQL, IBM DB2, Oracle Database, and/or the like.

In some implementations, the operating environment component may include an information handling subcomponent. The information handling subcomponent may provide the SCGP with capabilities to serve, deliver, upload, obtain, present, download, and/or the like a variety of information. The information handling subcomponent may use protocols such as Hypertext Transfer Protocol (HTTP), Hypertext Transfer Protocol Secure (HTTPS), File Transfer Protocol (FTP), Telnet, Secure Shell (SSH), Transport Layer Security (TLS), Secure Sockets Layer (SSL), peer-to-peer (P2P) protocols (e.g., BitTorrent), and/or the like to handle communication of information such as web pages, files, multimedia content (e.g., streaming media), applications, and/or the like.

In some embodiments, the information handling subcomponent may facilitate the serving of information to users, SCGP components, nodes in a computer network, web browsers, and/or the like. For example, the information handling subcomponent may comprise a web server such as Apache HTTP Server, Microsoft Internet Information Services (IIS), Oracle WebLogic Server, Adobe Flash Media Server, Adobe Content Server, and/or the like. Furthermore, a web server may include extensions, plug-ins, add-ons, servlets, and/or the like. For example, these may include Apache modules, IIS extensions, Java servlets, and/or the like. In some implementations, the information handling subcomponent may communicate with the database subcomponent via standards such as Open Database Connectivity (ODBC), Java Database Connectivity (JDBC), ActiveX Data Objects for .NET (ADO.NET), and/or the like. For example, the information handling subcomponent may use such standards to store, analyze, retrieve, access, modify, delete, aggregate, generate, and/or the like data (e.g., data from data stores 930) via the database subcomponent.

In some embodiments, the information handling subcomponent may facilitate presentation of information obtained from users, SCGP components, nodes in a computer network, web servers, and/or the like. For example, the information handling subcomponent may comprise a web browser such as Microsoft Internet Explorer, Mozilla Firefox, Apple Safari, Google Chrome, Opera Mobile, Amazon Silk, Nintendo 3DS Internet Browser, and/or the like. Furthermore, a web browser may include extensions, plug-ins, add-ons, applets, and/or the like. For example, these may include Adobe Flash Player, Adobe Acrobat plug-in, Microsoft Silverlight plug-in, Microsoft Office plug-in, Java plug-in, and/or the like.

In some implementations, the operating environment component may include a messaging subcomponent. The messaging subcomponent may facilitate SCGP message communications capabilities. The messaging subcomponent may use protocols such as Simple Mail Transfer Protocol (SMTP), Internet Message Access Protocol (IMAP), Post Office Protocol (POP), Extensible Messaging and Presence Protocol (XMPP), Real-time Transport Protocol (RTP), Internet Relay Chat (IRC), Skype protocol, AOL's Open System for Communication in Realtime (OSCAR), Messaging Application Programming Interface (MAPI), Facebook API, and/or the like to facilitate SCGP message communications. The messaging subcomponent may facilitate message communications such as email, instant messaging, Voice over IP (VoIP), video conferencing, Short Message Service (SMS), web chat, and/or the like. For example, the messaging subcomponent may comprise Microsoft Exchange Server, Microsoft Outlook, Sendmail, IBM Lotus Domino, Gmail, AOL Instant Messenger (AIM), Yahoo Messenger, ICQ, Trillian, Skype, Google Talk, Apple FaceTime, Apple iChat, Facebook Chat, and/or the like.

In some implementations, the operating environment component may include a security subcomponent that facilitates SCGP security. In some embodiments, the security subcomponent may restrict access to the SCGP, to one or more services provided by the SCGP, to data associated with the SCGP (e.g., stored in data stores 930), to communication messages associated with the SCGP, and/or the like to authorized users. Access may be granted via a login screen, via an API that obtains authentication information, via an authentication token, and/or the like. For example, the user may obtain access by providing a username and/or a password (e.g., a string of characters, a picture password), a personal identification number (PIN), an identification card, a magnetic stripe card, a smart card, a biometric identifier (e.g., a finger print, a voice print, a retina scan, a face scan), a gesture (e.g., a swipe), a media access control (MAC) address, an IP address, and/or the like. Various security models such as access-control lists (ACLs), capability-based security, hierarchical protection domains, and/or the like may be used to control access. For example, the security subcomponent may facilitate digital rights management (DRM), network intrusion detection, firewall capabilities, and/or the like.

In some embodiments, the security subcomponent may use cryptographic techniques to secure information (e.g., by storing encrypted data), verify message authentication (e.g., via a digital signature), provide integrity checking (e.g., a checksum), and/or the like by facilitating encryption and/or decryption of data. Furthermore, steganographic techniques may be used instead of or in combination with cryptographic techniques. Cryptographic techniques used by the SCGP may include symmetric key cryptography using shared keys (e.g., using one or more block ciphers such as triple Data Encryption Standard (DES), Advanced Encryption Standard (AES); stream ciphers such as Rivest Cipher 4 (RC4), Rabbit), asymmetric key cryptography using a public key/private key pair (e.g., using algorithms such as Rivest-Shamir-Adleman (RSA), Digital Signature Algorithm (DSA)), cryptographic hash functions (e.g., using algorithms such as Message-Digest 5 (MD5), Secure Hash Algorithm 2 (SHA-2)), and/or the like. For example, the security subcomponent may comprise a cryptographic system such as Pretty Good Privacy (PGP).

In some implementations, the operating environment component may include a virtualization subcomponent that facilitates SCGP virtualization capabilities. In some embodiments, the virtualization subcomponent may provide support for platform virtualization (e.g., via a virtual machine). Platform virtualization types may include full virtualization, partial virtualization, paravirtualization, and/or the like. In some implementations, platform virtualization may be hardware-assisted (e.g., via support from the processor using technologies such as AMD-V, Intel VT-x, and/or the like). In some embodiments, the virtualization subcomponent may provide support for various other virtualized environments such as via operating-system level virtualization, desktop virtualization, workspace virtualization, mobile virtualization, application virtualization, database virtualization, and/or the like. In some embodiments, the virtualization subcomponent may provide support for various virtualized resources such as via memory virtualization, storage virtualization, data virtualization, network virtualization, and/or the like. For example, the virtualization subcomponent may comprise VMware software suite (e.g., VMware Server, VMware Workstation, VMware Player, VMware ESX, VMware ESXi, VMware ThinApp, VMware Infrastructure), Parallels software suite (e.g., Parallels Server, Parallels Workstation, Parallels Desktop, Parallels Mobile, Parallels Virtuozzo Containers), Oracle software suite (e.g., Oracle VM Server for SPARC, Oracle VM Server for x86, Oracle VM VirtualBox, Oracle Solaris 10, Oracle Solaris 11), Informatica Data Services, Wine, and/or the like.

In some embodiments, components 940 may include a user interface component **940*b***. The user interface component may facilitate user interaction with the SCGP by providing a user interface. In various implementations, the user interface component may include programmatic instructions to obtain input from and/or provide output to the user via physical controls (e.g., physical buttons, switches, knobs, wheels, dials), textual user interface, audio user interface, GUI, voice recognition, gesture recognition, touch and/or multi-touch user interface, messages, APIs, and/or the like. In some implementations, the user interface component may make use of the user interface elements provided by the operating system subcomponent of the operating environment component. For example, the user interface component may make use of the operating system subcomponent's user interface elements via a widget toolkit. In some implementations, the user interface component may make use of information presentation capabilities provided by the information handling subcomponent of the operating environment component. For example, the user interface component may make use of a web browser to provide a user interface via HTML5, Adobe Flash, Microsoft Silverlight, and/or the like.

In some embodiments, components 940 may include any of the components SAPRH **940*c*, SWARH 940*d*** described in more detail in preceding figures.

The Embodiments of the SCGP

The entirety of this disclosure (including the written description, figures, claims, abstract, appendices, and/or the like) for SMART CAREGIVER PLATFORM METHODS, APPARATUSES AND MEDIA shows various embodiments via which the claimed innovations may be practiced. It is to be understood that these embodiments and the features they describe are a representative sample presented to assist in understanding the claimed innovations, and are not exhaustive and/or exclusive. As such, the various embodiments, implementations, examples, and/or the like are deemed non-limiting throughout this disclosure. Furthermore, alternate undescribed embodiments may be available (e.g., equivalent embodiments). Such alternate embodiments have not been discussed in detail to preserve space and/or reduce repetition. That alternate embodiments have not been discussed in detail is not to be considered a disclaimer of such alternate undescribed embodiments, and no inference should be drawn regarding such alternate undescribed embodiments relative to those discussed in detail in this disclosure. It is to be understood that such alternate undescribed embodiments may be utilized without departing from the spirit and/or scope of the disclosure. For example, the organizational, logical, physical, functional, topological, and/or the like structures of various embodiments may differ. In another example, the organizational, logical, physical, functional, topological, and/or the like structures of the SCGP coordinator, SCGP coordinator elements, SCGP data stores, SCGP components and their subcomponents, capabilities, applications, and/or the like described in various embodiments throughout this disclosure are not limited to a fixed operating order and/or arrangement, instead, all equivalent operating orders and/or arrangements are contemplated by this disclosure. In yet another example, the SCGP coordinator, SCGP coordinator elements, SCGP data stores, SCGP components and their subcomponents, capabilities, applications, and/or the like described in various embodiments throughout this disclosure are not limited to serial execution, instead, any number and/or configuration of threads, processes, instances, services, servers, clients, nodes, and/or the like that execute in parallel, concurrently, simultaneously, synchronously, asynchronously, and/or the like is contemplated by this disclosure. Furthermore, it is to be understood that some of the features described in this disclosure may be mutually contradictory, incompatible, inapplicable, and/or the like, and are not present simultaneously in the same embodiment. Accordingly, the various embodiments, implementations, examples, and/or the like are not to be considered limitations on the disclosure as defined by the claims or limitations on equivalents to the claims.

This disclosure includes innovations not currently claimed. Applicant reserves all rights in such currently unclaimed innovations including the rights to claim such innovations and to file additional provisional applications, nonprovisional applications, continuation applications, continuation-in-part applications, divisional applications, and/or the like. It is to be understood that while some embodiments of the SCGP discussed in this disclosure have been directed to helping people with memory problems, the innovations described in this disclosure may be readily applied to a wide variety of other fields and/or applications (e.g., tracking cats, dogs and other animals, tracking personal belongings).

The invention claimed is:

1. A processor-implemented method to detect user wandering, comprising:

determining via the processor that an analysis of a user's location data indicates that a condition signifying that the user is wandering has been triggered;

generating via the processor directions to an approved location for the user;

concluding via the processor that the user did not follow the directions when the user does not reach the approved location within a specified time period; and facilitating via the processor alerting a user's caregiver that the user is wandering.

2. The method of claim 1, wherein the location data comprises the user's location or direction of travel.

3. The method of claim 1, wherein the approved location is specified by the caregiver.

4. The method of claim 3, wherein the caregiver specifies geographic coordinates associated with the approved location.

5. The method of claim 3, wherein the caregiver specifies geographic boundaries associated with the approved location.

6. The method of claim 3, wherein the caregiver specifies at least one of weather conditions, temperature conditions, date conditions, or time conditions associated with the approved location.

7. The method of claim 1, wherein the approved location is the closest approved location to the user.

8. The method of claim 1, wherein the condition is triggered when the user is outside a designated safe area.

9. The method of claim 1, wherein the condition is triggered when (1) the user is not at one of the approved locations and (2) the user is not travelling via an approved route.

10. The method of claim 1, further comprising:

logging that the user is wandering; and generating a user wandering report, using the logged data, to facilitate understanding when the user is likely to wander.

11. The method of claim 1, further comprising facilitating connecting the user with the user's caregiver via an audio call or video call.

12. A user wandering detecting apparatus, comprising:

a memory;

a processor in communication with the memory, and configured to issue a plurality of processing instructions stored in the memory, wherein the processor issues instructions to:

determine via the processor that an analysis of a user's location data indicates that a condition signifying that the user is wandering has been triggered;

generate via the processor directions to an approved location for the user;

conclude via the processor that the user did not follow the directions when the user does not reach the approved location within a specified time period; and facilitate via the processor alerting a user's caregiver that the user is wandering.

13. The apparatus of claim 12, wherein the apparatus is a smart bracelet or a smart watch.

14. The apparatus of claim 12, wherein the apparatus is a smartphone.

15. The apparatus of claim 12, wherein instructions to facilitate alerting the user's caregiver further comprise instructions to generate an alert message to be sent to the caregiver's smartphone.

16. A device that detects wandering comprising:

a memory;

a processor in communication with the memory, and configured to issue a plurality of processing instructions stored in the memory, wherein the processor issues instructions to:

obtain via the processor location data associated with the device;

retrieve via the processor approved location data associated with one or more approved locations for the device;

analyze via the processor the obtained location data with respect to the retrieved approved locations data;

determine via the processor that an analysis indicates that a condition signifying wandering has been triggered;

generate via the processor directions to an approved location;

conclude via the processor that the directions were not followed when the device does not reach the approved location within a predetermined time period; and facilitate via the processor generating an alert notification.

17. The device of claim 16, wherein the processor further issues instructions to:

send the alert notification via network.

18. The device of claim 16, wherein the location data is determined using a GPS associated with the device.

19. The device of claim 16, wherein the analysis includes analyzing geographic coordinates or geographic boundaries specified in the approved locations data.

20. The device of claim 16, wherein the analysis includes analyzing conditions specified in the approved locations data based on conditions data, wherein the conditions data is obtained via a sensor of the device or via information from a third party provider.

* * * * *